United States Patent [19]

Lehmann et al.

[11] Patent Number: 4,946,413

[45] Date of Patent: Aug. 7, 1990

[54] MULTI-USE TOY

[76] Inventors: Roger W. Lehmann, 18 Flintlock Ct., Bernardsville, N.J. 07924; Michael I. Satten, 4 Farmers Rd., Kings Point, N.Y. 11024

[21] Appl. No.: 248,397

[22] Filed: Sep. 23, 1988

[51] Int. Cl.[5] ..... A63H 33/00

[52] U.S. Cl. ..... 446/28; 446/75; 446/76

[58] Field of Search ..... 446/28, 73, 75, 76, 446/77, 71, 434; 206/547, 216, 217, 579

[56] References Cited

U.S. PATENT DOCUMENTS 4,165,579 8/1979 Chase ..... 446/73
4,433,504 2/1984 Terui ..... 446/75
4,516,948 5/1985 Obara ..... 446/434 X
4,690,654 9/1987 Delaney ..... 446/28

FOREIGN PATENT DOCUMENTS 1483751 8/1977 United Kingdom ..... 446/434

*Primary Examiner*—Mickey Yu
*Attorney, Agent, or Firm*—Stoll, Previto & Hoffman

[57] ABSTRACT

A multiple-use toy in the form of a useful article having the configuration of a type of article recognizable by children and being of a generally normal size for that type of article, and a toy set of miniature size built into said useful article, the useful article being adapted to be opened to expose the toy set, and the useful article, when closed being adapted to be used as a toy, the toy set being adapted to be used as a toy when the useful article is opened.

5 Claims, 25 Drawing Sheets

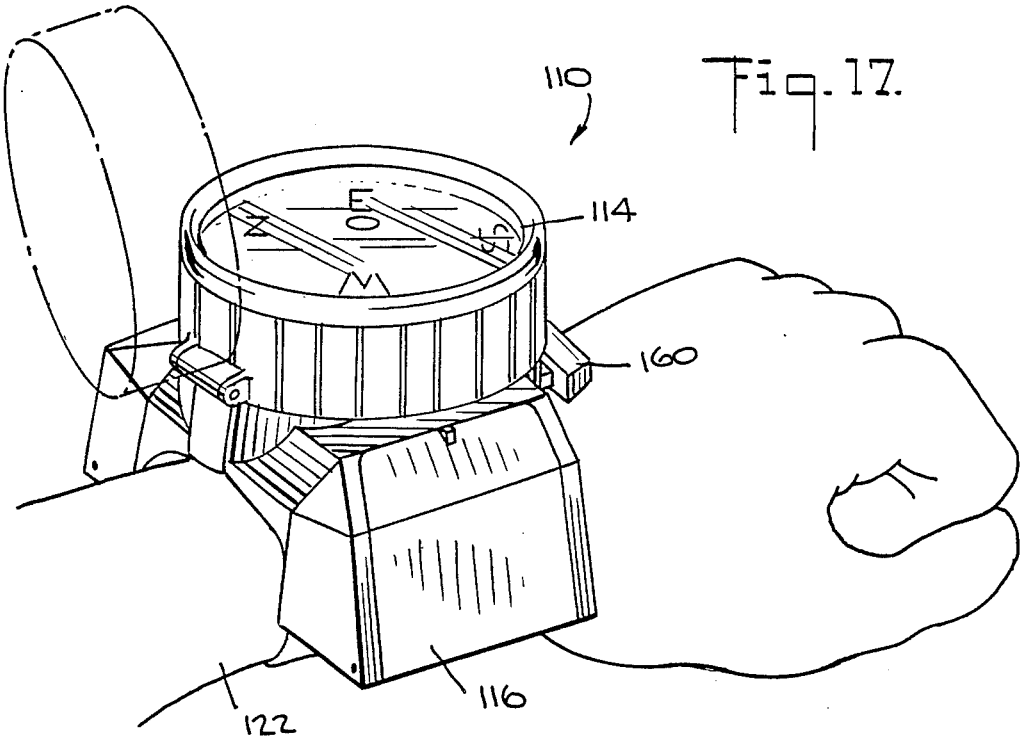
Fig. 17.
Fig. 18.
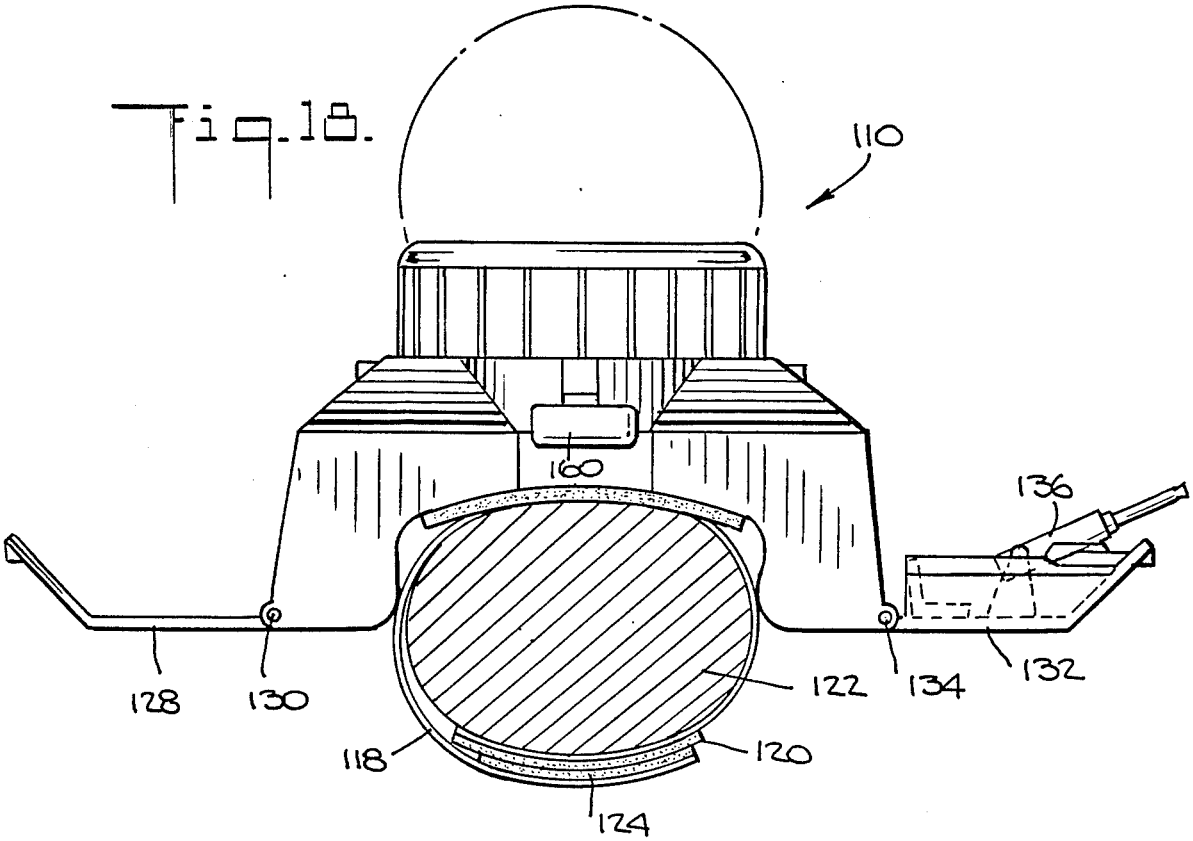

Fig. 23.
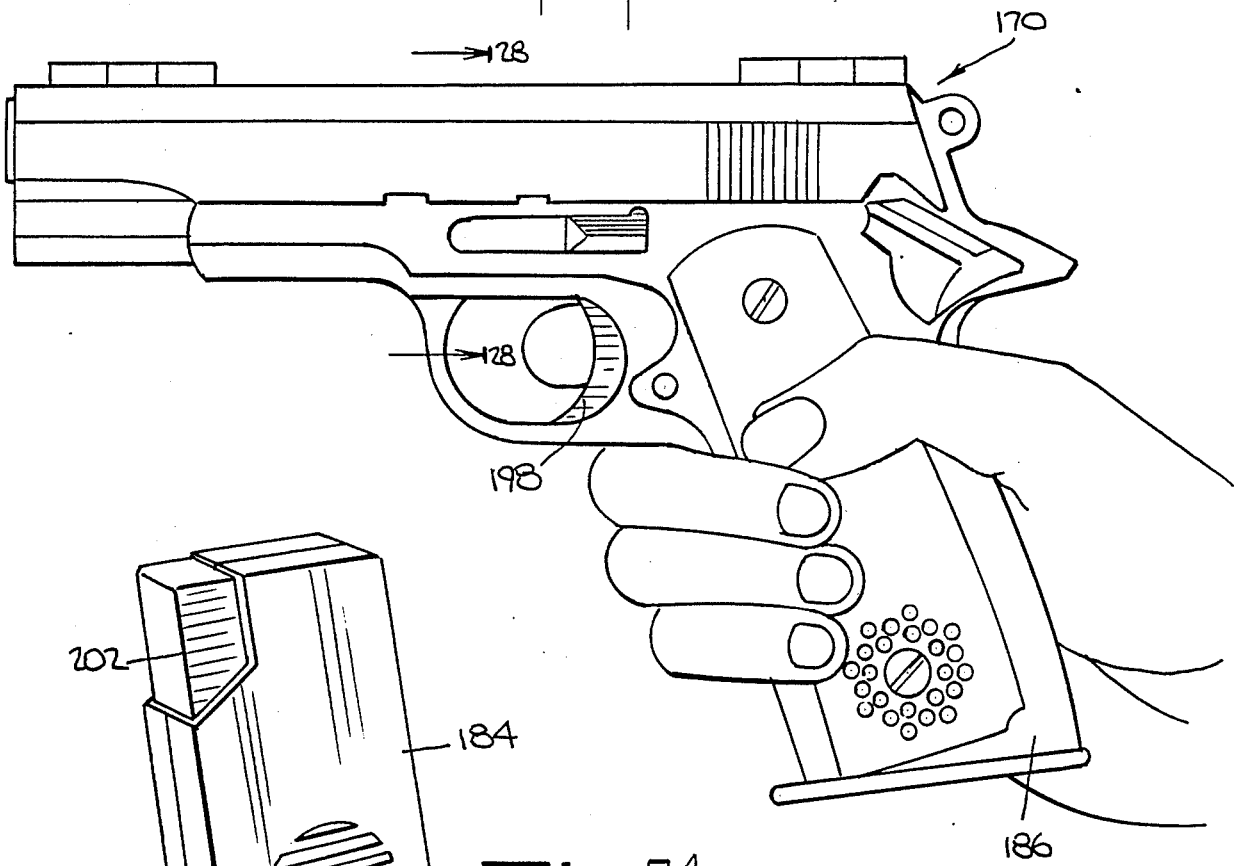
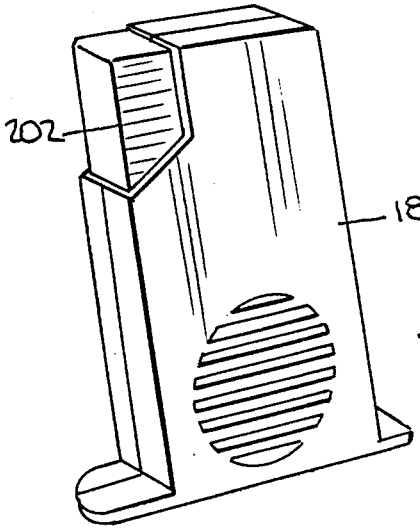
Fig. 24.
Fig. 25.
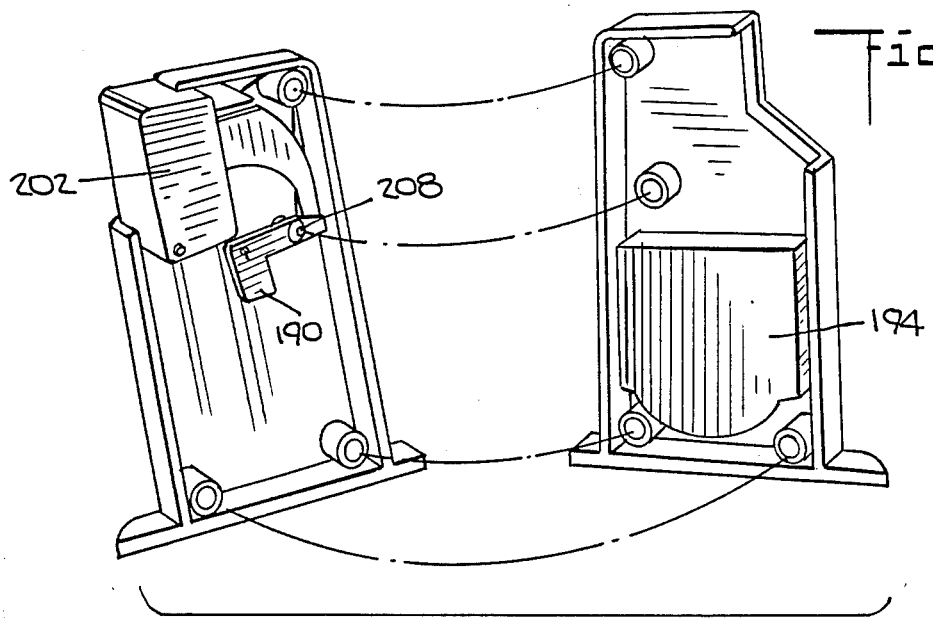

184
194
208
204
190
202
200
198
192
188
206

240
242
234
274
276
284
286
282
280
260
254
268
278
266
222
270
164

MULTI-USE TOY

BACKGROUND AND SUMMARY OF THE INVENTION

This invention relates to the general category of convertible toys.

The most pertinent prior art known to applicants is comprised of the following U.S. patents:

| | |
|---|---|
| Des.278,643 | 4,571,201 |
| Des.279,591 | 4,571,203 |
| Des.279,592 | 4,575,348 |
| Des.284,948 | 4,575,352 |
| Des.291,973 | 4,578,046 |
| Des.295,994 | 4,580,993 |
| 3,878,639 | 4,581,904 |
| 4,095,367 | 4,586,911 |
| 4,170,840 | 4,594,071 |
| 4,391,060 | 4,599,078 |
| 4,411,097 | 4,605,383 |
| 4,456,384 | 4,606,618 |
| 4,505,686 | 4,623,317 |
| 4,516,948 | 4,666,042 |
| 4,530,670 | 4,668,205 |
| 4,543,073 | 4,673,373 |
| 4,561,184 | 4,680,018 |
| 4,571,199 | |

The basic difference between these prior art patents and the present invention resides in the fact that in the prior art one toy is itself changed into another toy, whereas in the present invention there are two toys, that is, an outer toy and an inner toy built into the outer toy. In this invention, each toy retains its own identity except that the outer toy must be opened up to expose the inner toy. The outer toy is operable only when closed; the inner toy is operable only when the outer toy is opened.

To illustrate the prior art, Des. 295,994 shows a "Reconfigurable Toy Aircraft-Carrier" which is transformable into an airplane and/or a robot. One of the embodiments of the present invention is a simulated canteen which contains a built-in aircraft carrier. It is necessary to open up the canteen in order to expose the aircraft carrier but this does not "reconfigure" the canteen. The configuration of the canteen is retained except that it is opened to expose the aircraft carrier.

There is another important difference between the present invention and the prior art: in the present invention, unlike the prior art, the outer article is of generally normal size for that type of article, whereas the inner toy is of miniature size. Thus, in the above illustration, the outer article is a canteen and the inner toy that is built into it is an aircraft carrier.

BRIEF DESCRIPTION OF THE DRAWING

FIG. 13 is a similar view, partly exploded, showing a jet fighter plane removed from a compartment of the canteen.

FIG. 17 is a perspective view of a third illustration of the invention wherein the useful article is a wrist-mounted compass, showing it worn on the wrist.

FIG. 18 is a side view thereof.

FIG. 23 is a side view of a fourth illustration of the invention wherein the useful article is a pistol, shown held in the hand.

FIG. 24 is a perspective view of a cartridge clip for said pistol.

FIG. 25 is an exploded perspective view of said cartridge clip.

FIG. 33 is a fragmentary, perspective view of the pistol showing a cruise missile in simulated flight.

FIG. 34 is a fragmentary view showing the wing-extending mechanism of the cruise missile.

FIG. 35 is a view similar to that of FIG. 34 but showing the wings in extended positions.

FIG. 36 is a perspective view of a fifth illustration of the invention wherein the useful article is a searchlight.

FIG. 39 is a longitudinal section therethrough.

DESCRIPTION OF THE INVENTION

Figure 12:
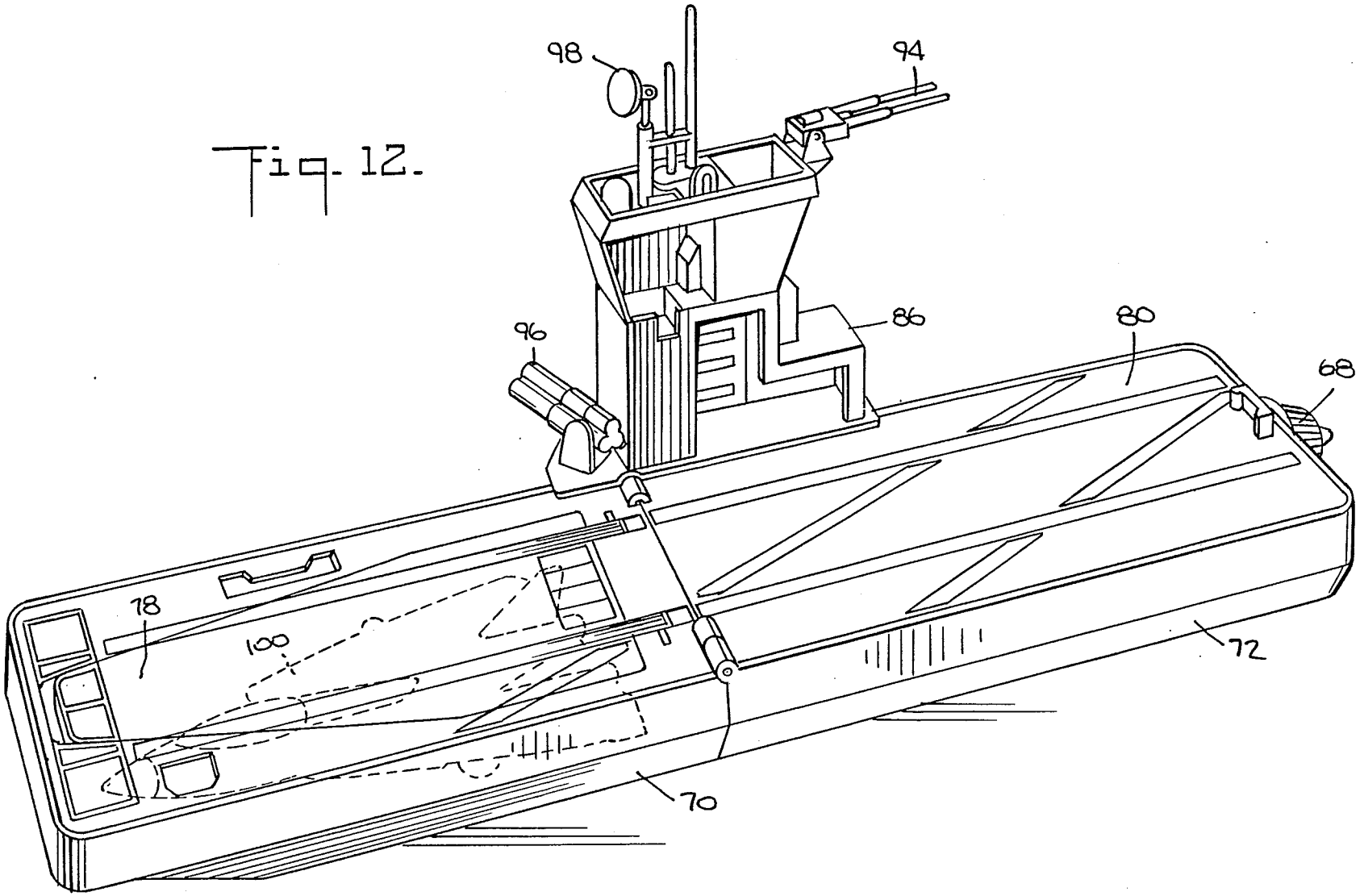
FIG. 12 is a perspective view of the open canteen showing the aircraft carrier that is built into it.
Figure 1E:
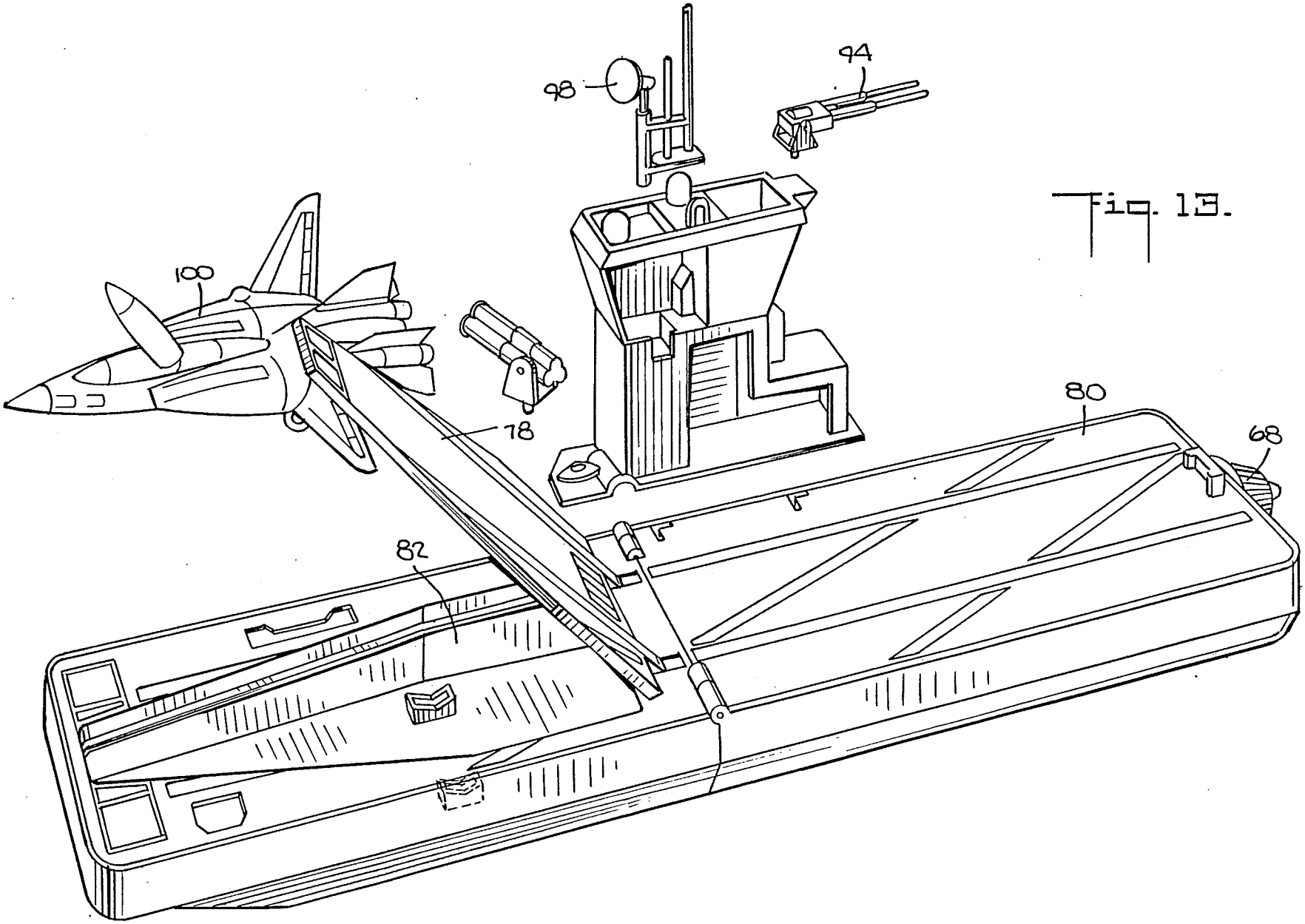
Figure 15:
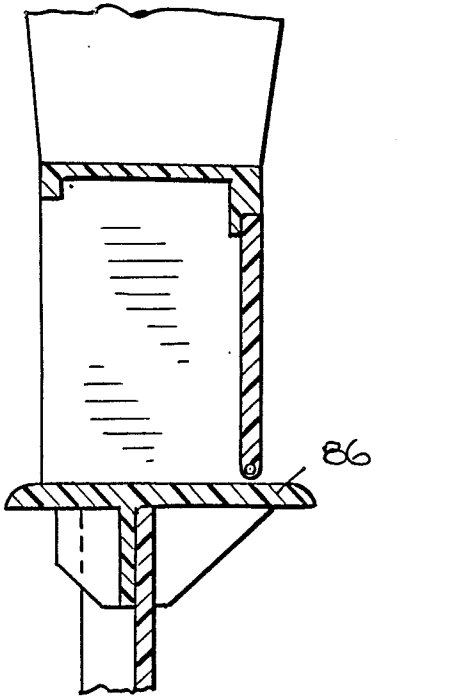
FIG. 15 is an enlarged, fragmentary, sectional view on the line 15—15 of FIG. 14.
Figure 14:
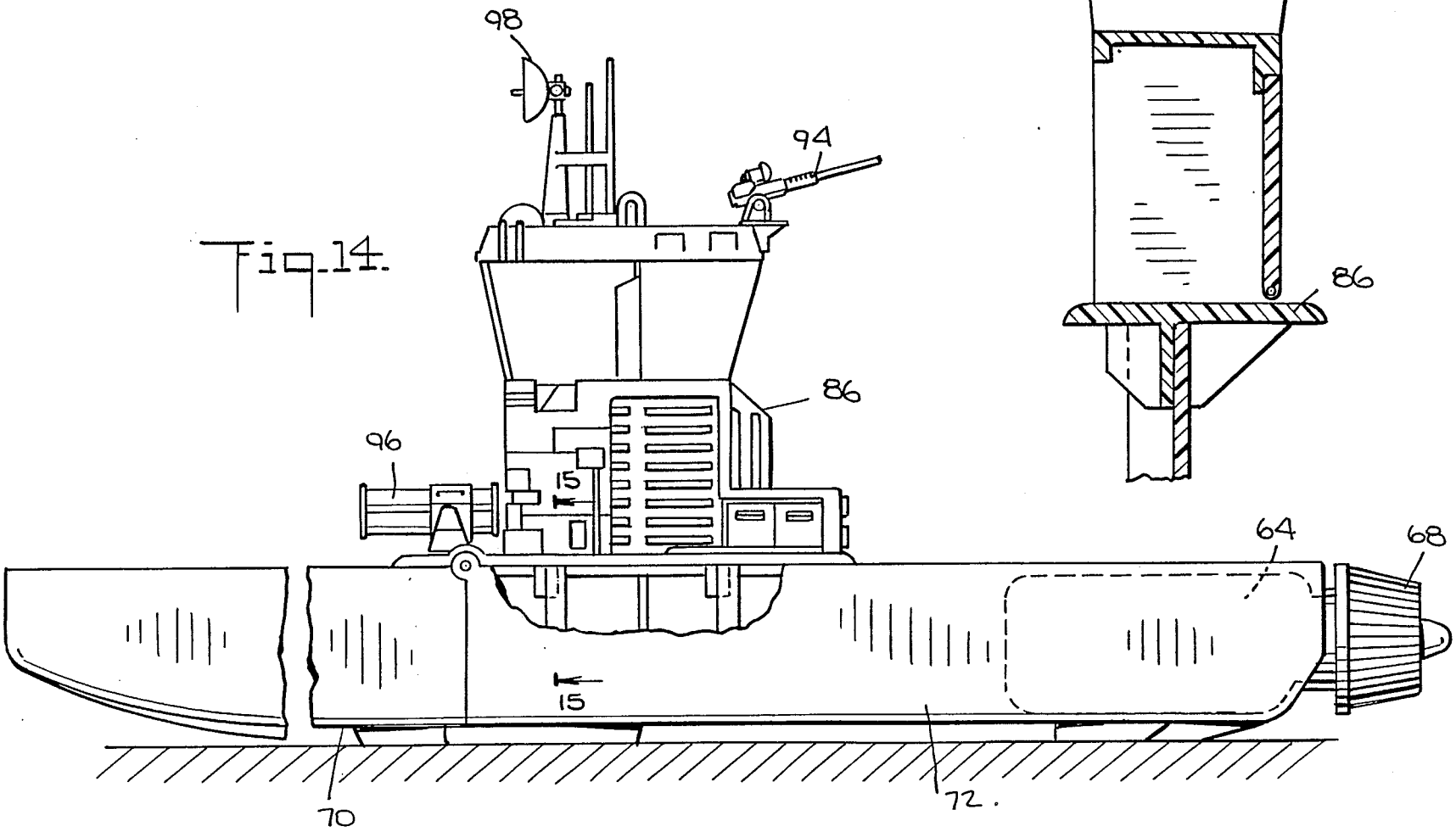
FIG. 14 is a side view of the aircraft carrier, partly broken away and in section.

Referring now to the first illustrative form of the invention (FIGS. 1–6), it will be seen that it comprises a useful article 10 in the form of a simulated hand grenade (FIG. 1) and an inner miniature play set 12 in the form of a vehicle-launching bunker (FIG. 12). The body 14 of the hand grenade supports three shell sections, namely, a fixed center section 16 and two side sections 18, 20 hingedly mounted on the body by means of hinge pins 22, 24.

Figure 3:
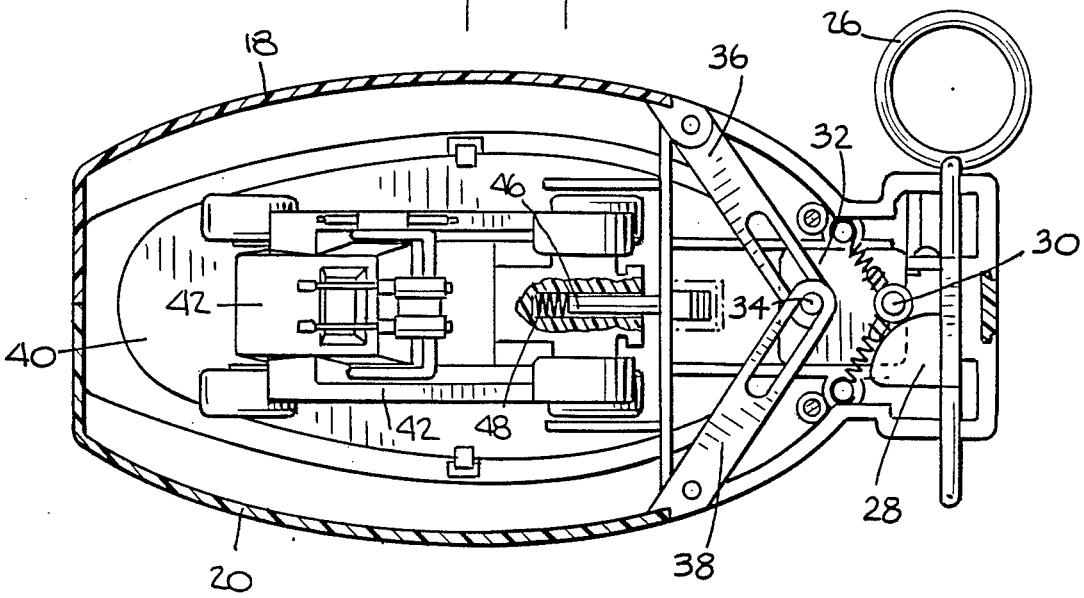
FIG. 3 is a longitudinal section on the line 3—3 of FIG. 1.
Figure 5:
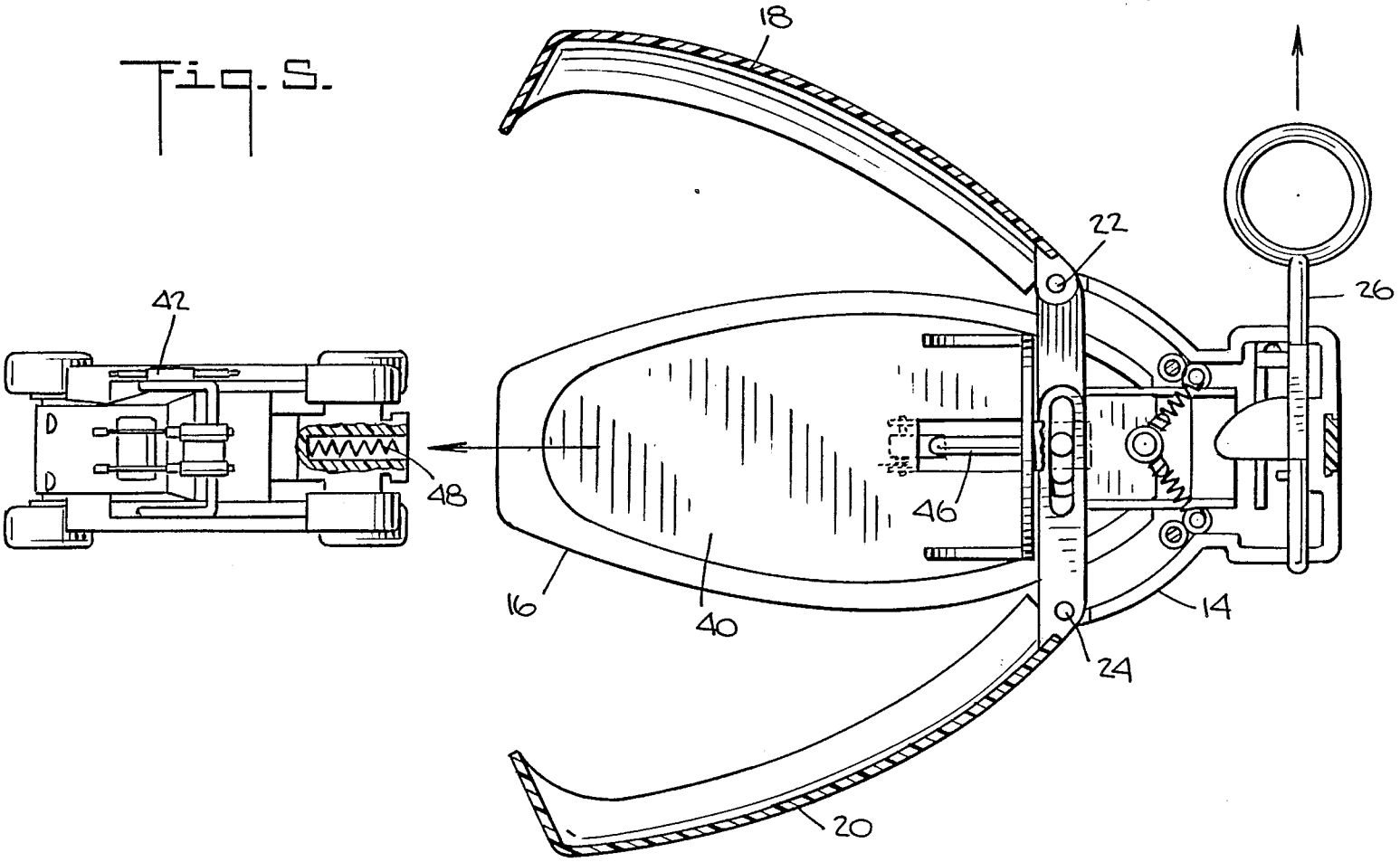
FIG. 5 is a top view, partly in section, of the opened hand grenade and the launched vehicle.

The hand grenade is provided with a firing mechanism safety pin 26 extending through body 14 and used to open the grenade. As shown in FIGS. 3 and 5, safety pin 26 has a cam element 28 that engages a spring-urged toggle element 30 centered on slide 32. Also mounted on slide 32 is a cam pin 34 that engages two slotted bars 36, 38 pivotally mounted on shell sections 18, 20. When safety pin 26 is pulled, cam 28 causes the toggle 30, slide 32 and pin 34 to move forwardly (leftwardly as viewed in FIG. 3) and thereby causes bars 36 and 38 to assume their aligned positions as shown in FIG. 5. This forces shell sections 18, 20 to swing outwardly and to open the grenade as shown in FIG. 5.

It will now be noted that a platform 40 is provided on the center shell 16 to support an assault vehicle 42. This vehicle is held in place on the platform by means of a spring-urged stop member 44 and a horizontal pin 46 secured to slide 32. Pin 46 extends in to a cylindrical receptacle 48 on the vehicle when the vehicle occupies the platform. A compression spring 50 in said receptacle is compressed by the pin. When the safety pin is pulled to open the grenade, slide 32 and pin 46 are thrust forwardly and a cam face 52 is engaged by the slide to disengage stop member 44 from the vehicle. This frees the vehicle for forward movement under the thrust of compressed spring 50.

Figures 1, 4:
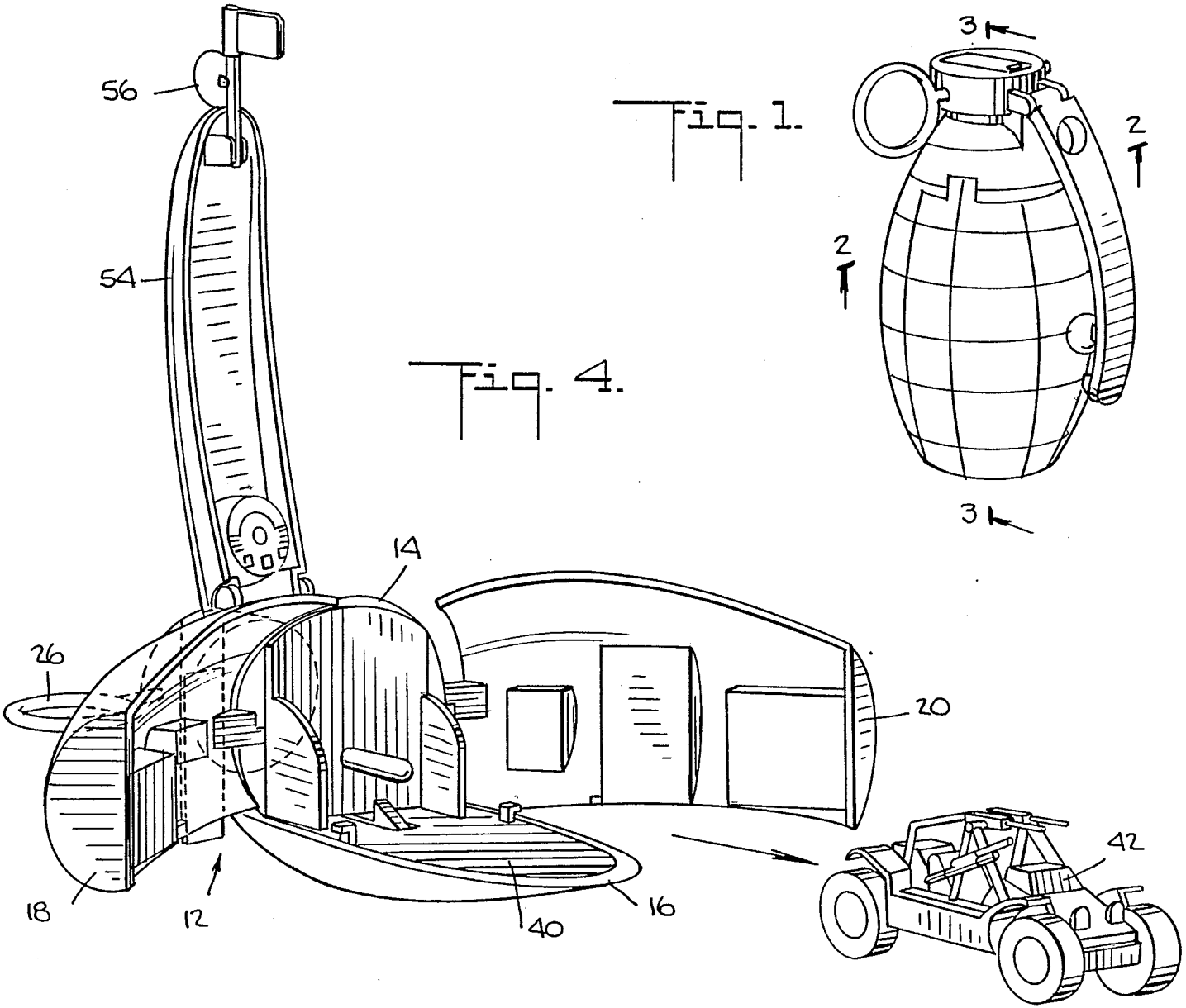
FIG. 1 is a side view of one illustrative form of the invention wherein the useful article is a simulated hand grenade.
FIG. 4 is a perspective, exploded view showing the hand grenade opened up to expose a built-in vehicle-launching bunker and a launched vehicle.
Figure 2:
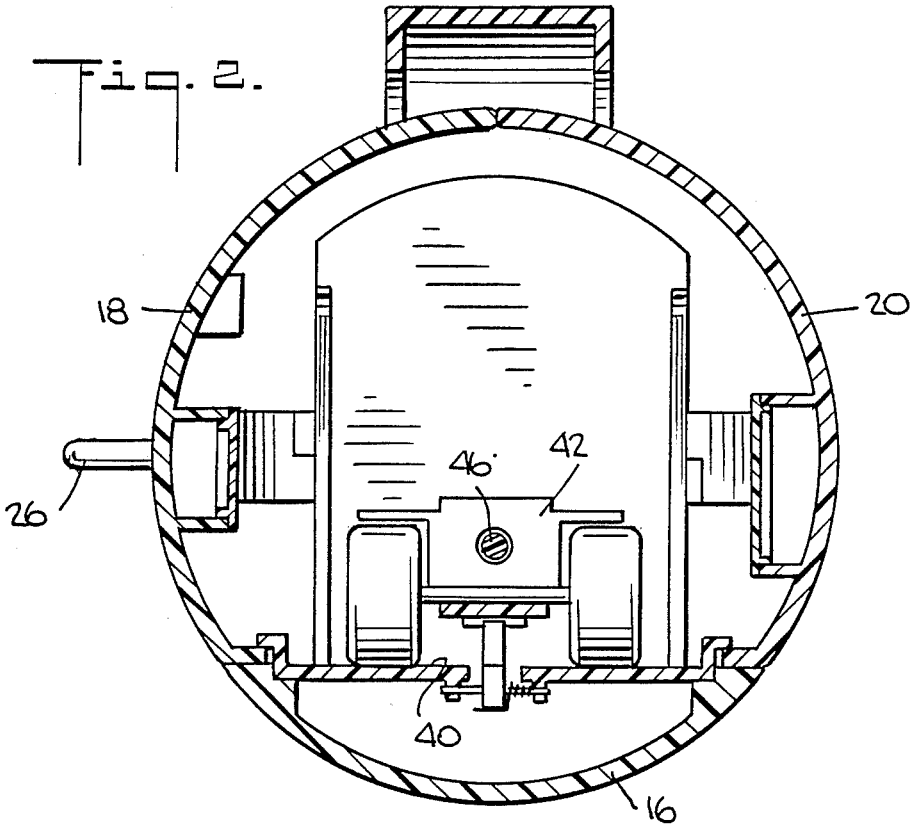
FIG. 2 is a cross-section on the line 2—2 of FIG. 1.
Figure 6:
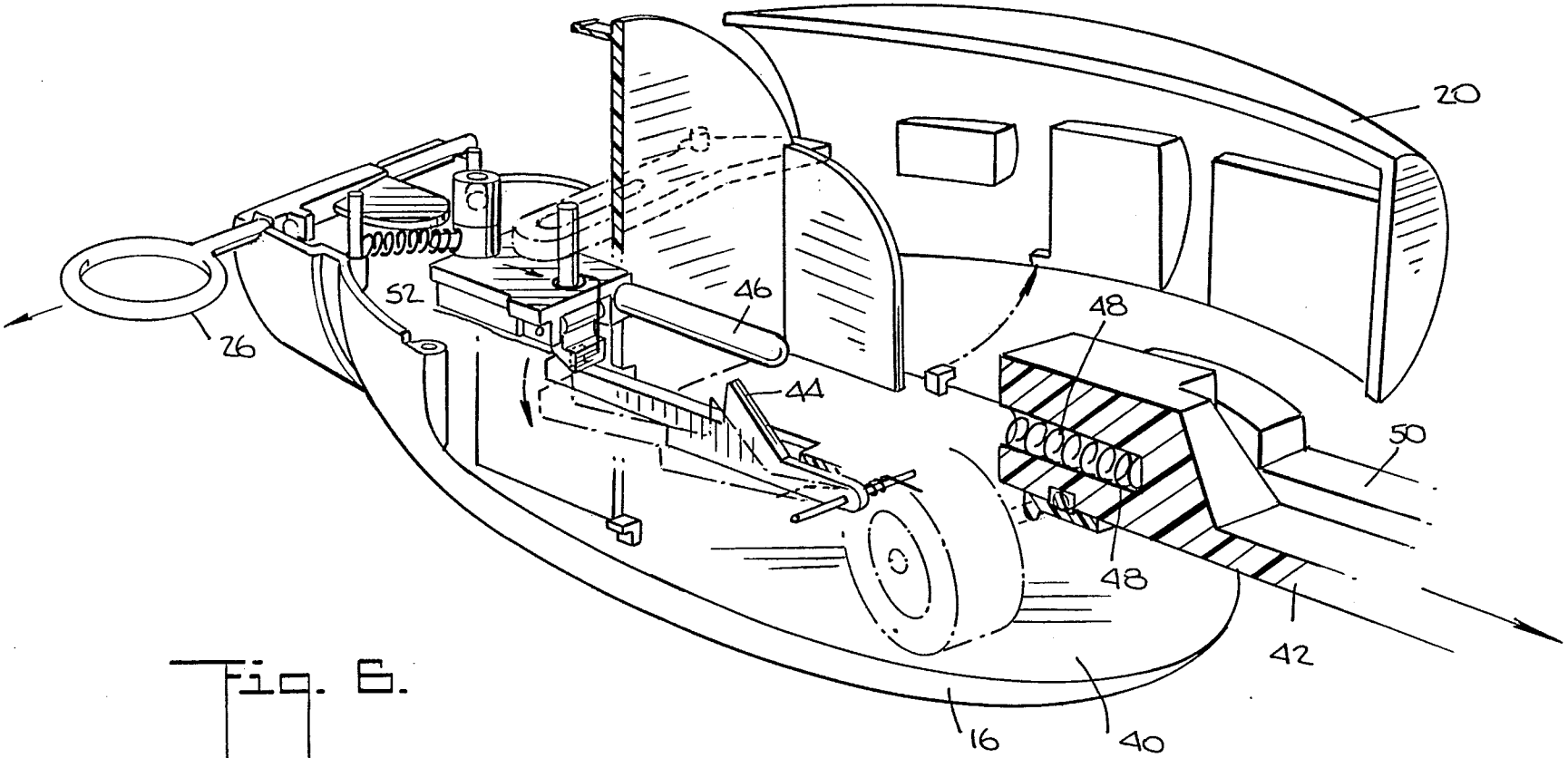
FIG. 6 is a perspective, enlarged view, partly in longitudinal section, showing the opened hand grenade and vehicle launching mechanism.

It will also be observed in FIGS. 4 and 6 that the open shell sections 18, 20 have other built-in vehicle-launching bunker features. Additionally, safety lever 54 on the grenade body is pivotally mounted thereon for movement to a radial position relative to the longitudinal axis of the grenade. In this position, safety lever 54 becomes a mast supporting a pivotable radar dish 56.

Figure 11:
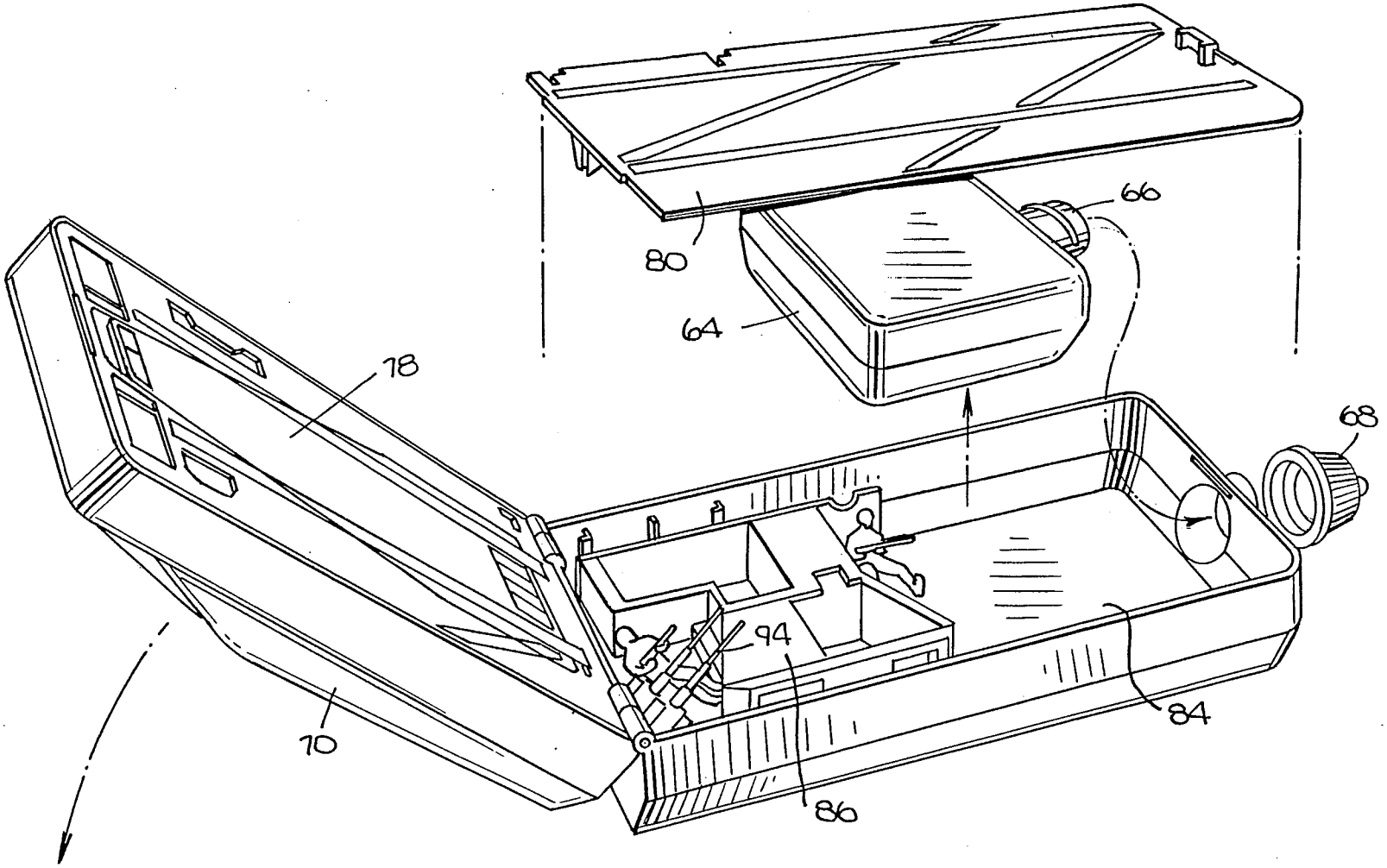
FIG. 11 is a perspective, exploded view showing the canteen open and a water container removed therefrom.

The second embodiment of the invention (FIGS. 7–16) comprises a useful article 60 in the form of a canteen and an inner miniature playset 62 in the form of an aircraft carrier. The canteen may have an actual container 64 for water, including a spout 66 and a closure cap 68 (FIG. 11). Container 64 is housed within the canteen the spout 66 projecting outwardly from the canteen and the cap attached to said spout.

The canteen is made of two shells 70, 72 hinged together at one end by means of hinges 74. A conventional latch 76 at the opposite end holds the two shells together in closed position. When the canteen is opened, as shown, for example, in FIGS. 11, 12, 13, aircraft carrier 62 becomes visible. There are two removable flight decks 78, 80 covering two compartments 82, 84. Housed in compartment 84 is the water container 64. Also contained in compartment 84 are various parts of an aircraft carrier, including a control tower 86. The control tower may be placed on the decks to complete the aircraft carrier. To secure the control tower to the hull (shells 70, 72) of the aircraft carrier, detents 88 are provided on the bases of the control tower to engage slots 90 in the decks and a flange 92 adjacent the detents engages the hull of the aircraft carrier.

Other elements of the playset may include anti-aircraft guns 94, torpedo tubes 96 and radar dish 98. Housed in compartment 82 is a jet fighter 100.

Figure 7:
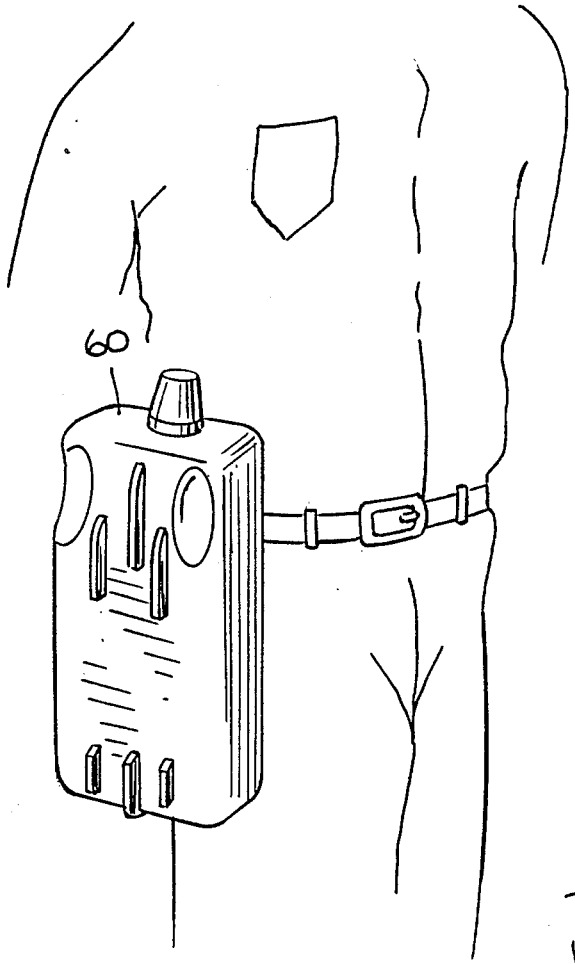
FIG. 7 is a perspective view of a second illustrative form of the invention wherein the useful article is a canteen, said canteen being shown supported on the belt of a child.
Figure 8:
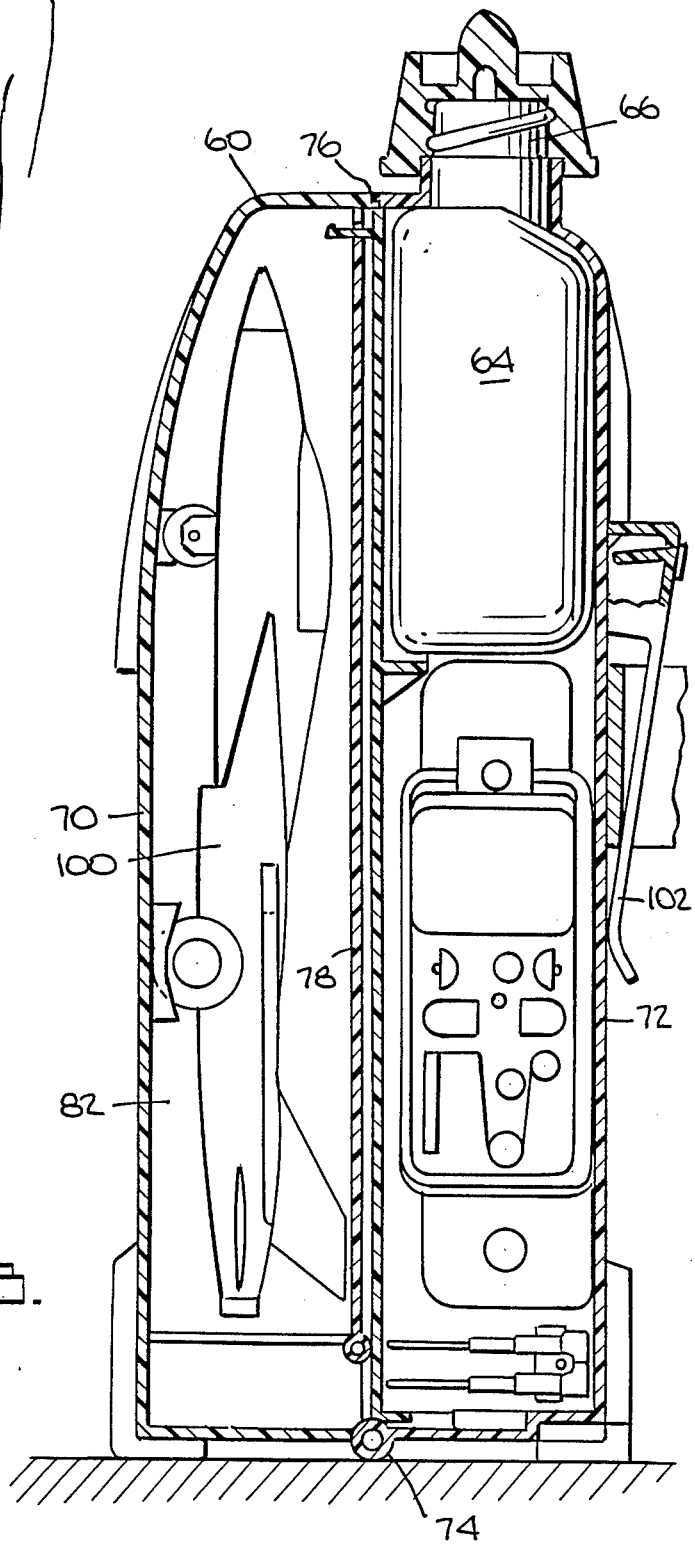
FIG. 8 is an enlarged, vertical section through said canteen.
Figure 9:
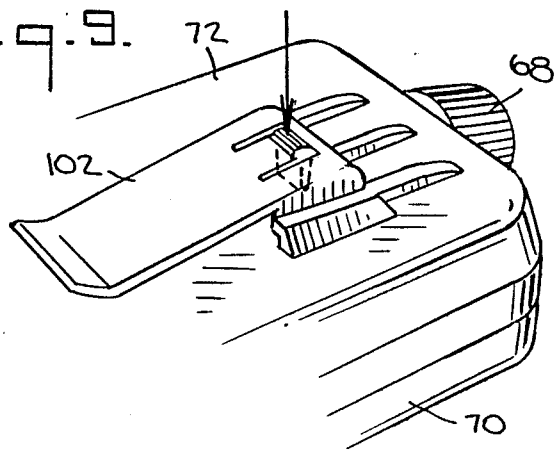
FIG. 9 is a fragmentary, perspective view of the canteen showing its supporting clip.
Figure 10:
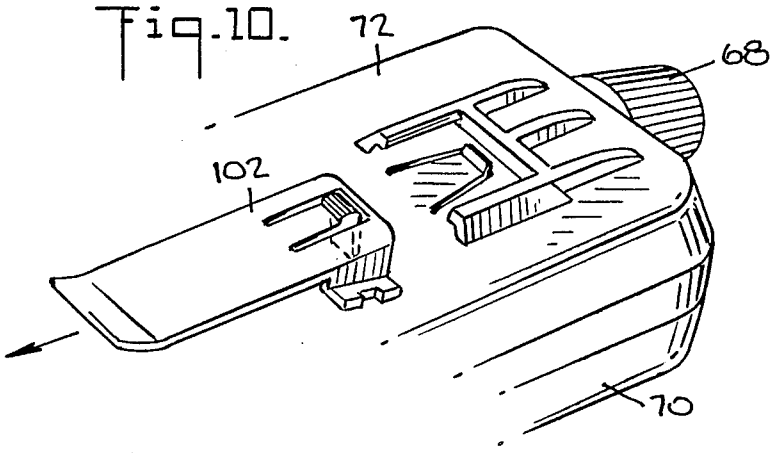
FIG. 10 is a similar but exploded view with the clip removed from its functional position on the canteen.
Figure 16:
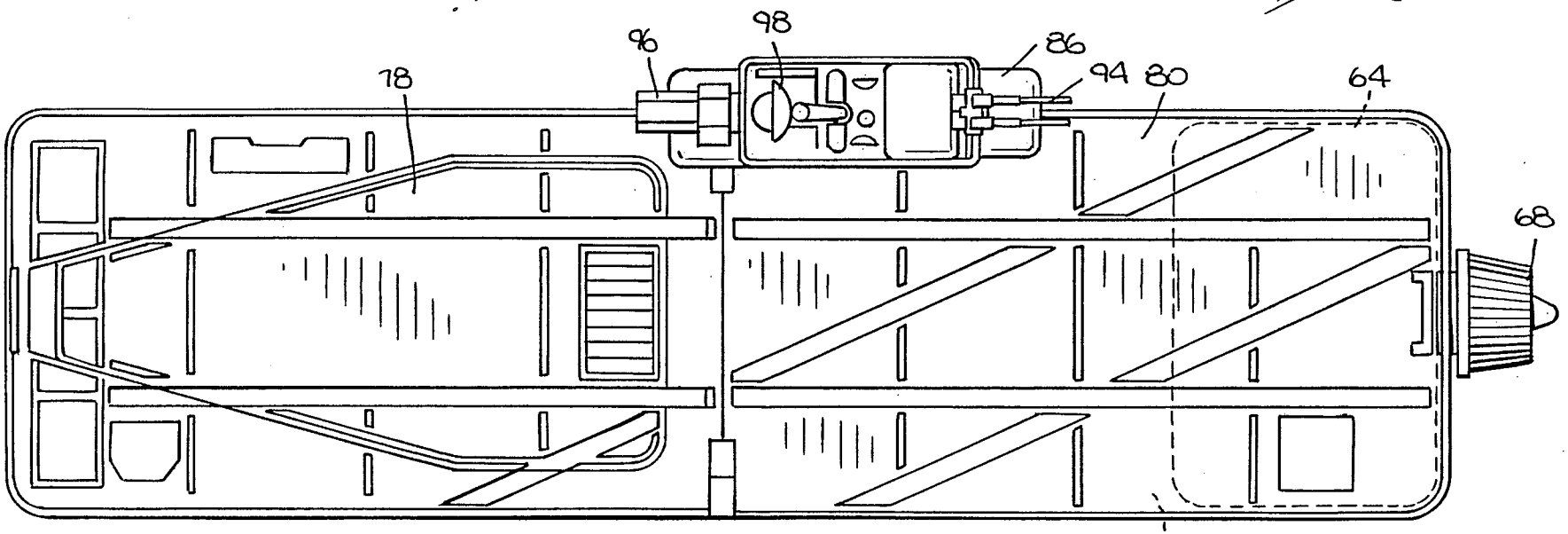
FIG. 16 is a top view of said aircraft carrier.

The canteen may be provided with a belt clip 102 for carrying purposes as shown in FIG. 7.

The third embodiment of the invention (FIGS. 17–22) comprises a useful article 110 in the form of a wrist-mounted compass, and an inner miniature playset 112 in the form of a satellite station including a satellite launcher. Specifically, useful article 110 comprises an actual magnetic compass 114, a housing 116 supporting said compass, and adjustable straps 118, 120 attached to said housing to hold it on the wearer's wrist 122. velcro-type pads 124 on the two straps adjustably secure the straps to each other.

It will be observed (FIG. 22), that housing 116 may be opened at the top by swinging the compass away from the housing on hinge 126, by swinging wall 128 away from the housing on hinges 1230, and by swinging wall 132 away from the housing on hinges 134. This exposes the satellite station 112. See, for example, the gun station 136 on wall 132, and the satellite launcher 138 within the top of the housing.

Figure 19:
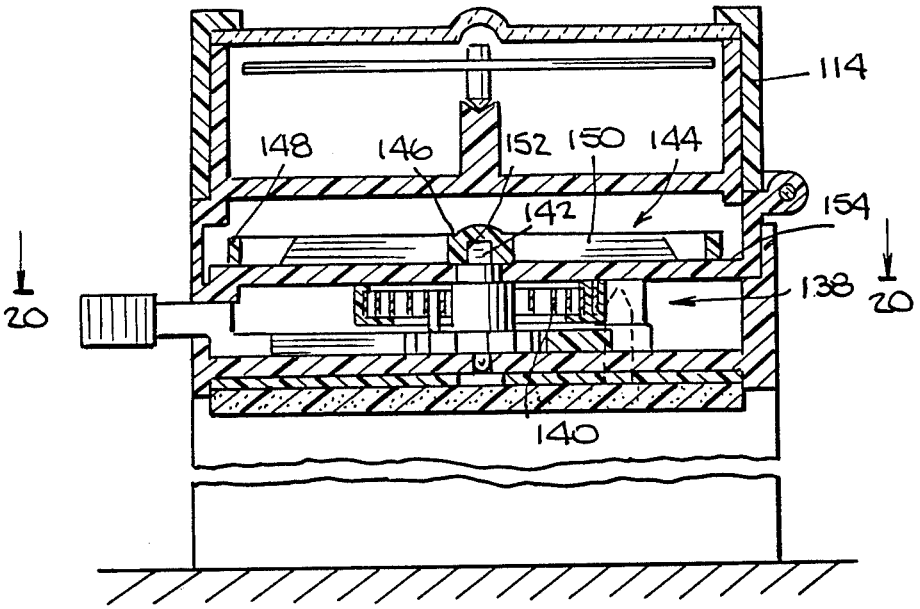
FIG. 19 is a transverse section therethrough showing the satellite mounted therein and the spring drive mechanism that propels the satellite.
Figure 22:
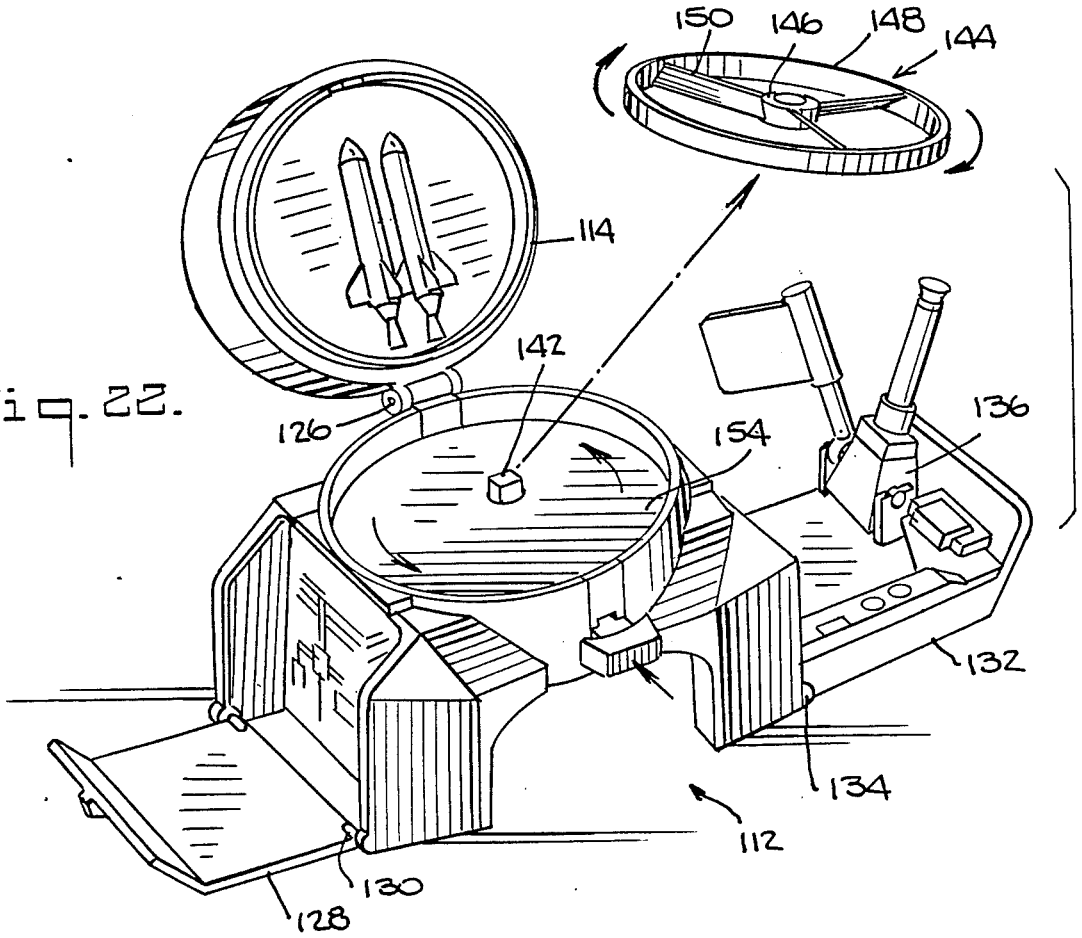
FIG. 22 is an exploded view showing the satellite in flight following release of the spring drive mechanism.
Figure 20:
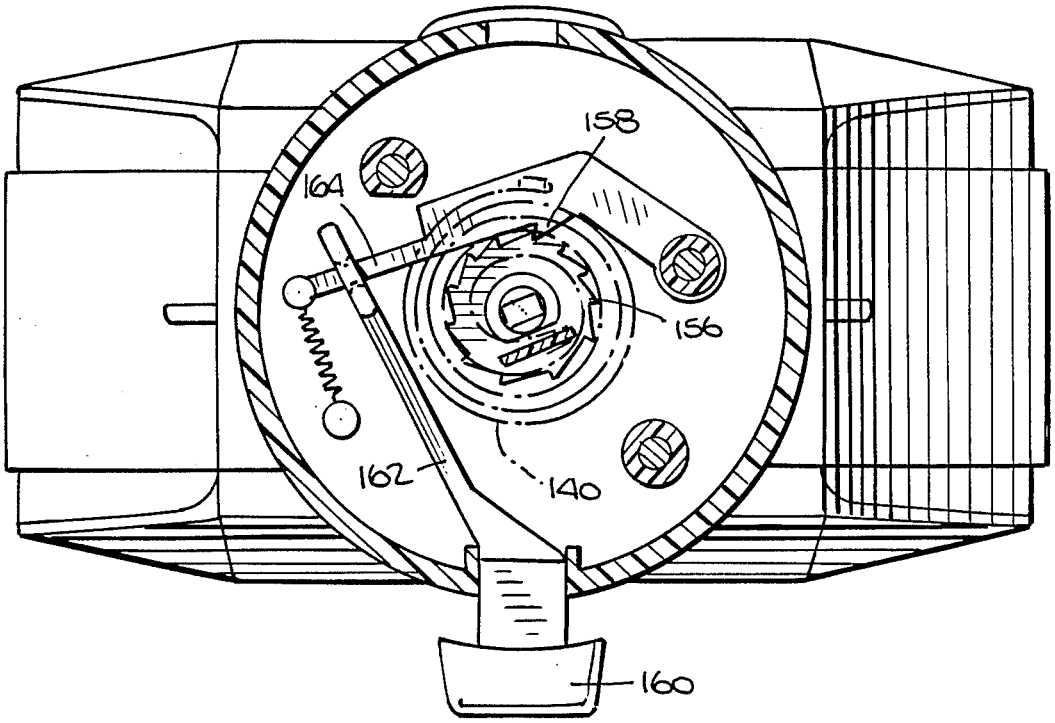
FIG. 20 is a transverse section on the line 20—20 of FIG. 19.
Figure 21:
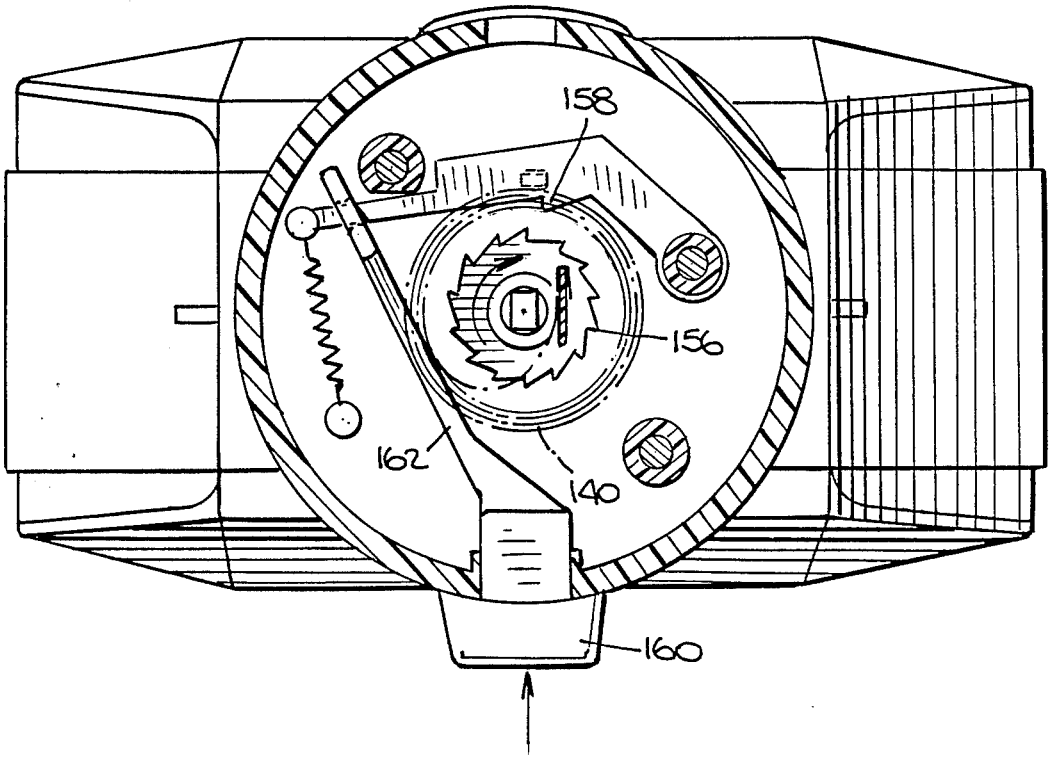
FIG. 21 is a similar view showing the spring drive mechanism released.

Inside the housing is a clock-spring mechanism 140 that drives a square shaft 142 (FIGS. 19, 22). A simulated satellite 144 consisting of a hub 146, a ring 148 and helicopter-type blades 150 between the hub and the ring. A square hold 152 in the hub receives square shaft 142. To operate the satellite launcher, satellite 144 is placed on launch platform 154 of the satellite launcher, the satellite hub engaging shaft 142, and the satellite is then manually rotated in spring winding direction. A ratchet 156 connected to the shaft is engaged by a spring-urged pawl 158 (FIGS. 20, 21) during the winding operation. To launch the satellite, a push button 160 having an extension arm 162 is pushed. This extension arm 162 engages an extension arm 164 on the pawl and disengages the pawl from the ratchet, thereby freeing the clockspring mechanism to launch the satellite.

When it is desired to close the housing, the compass and the two side walls are simply swung back to closed positions where they are retained by conventional snap-type latches.

Figure 30:
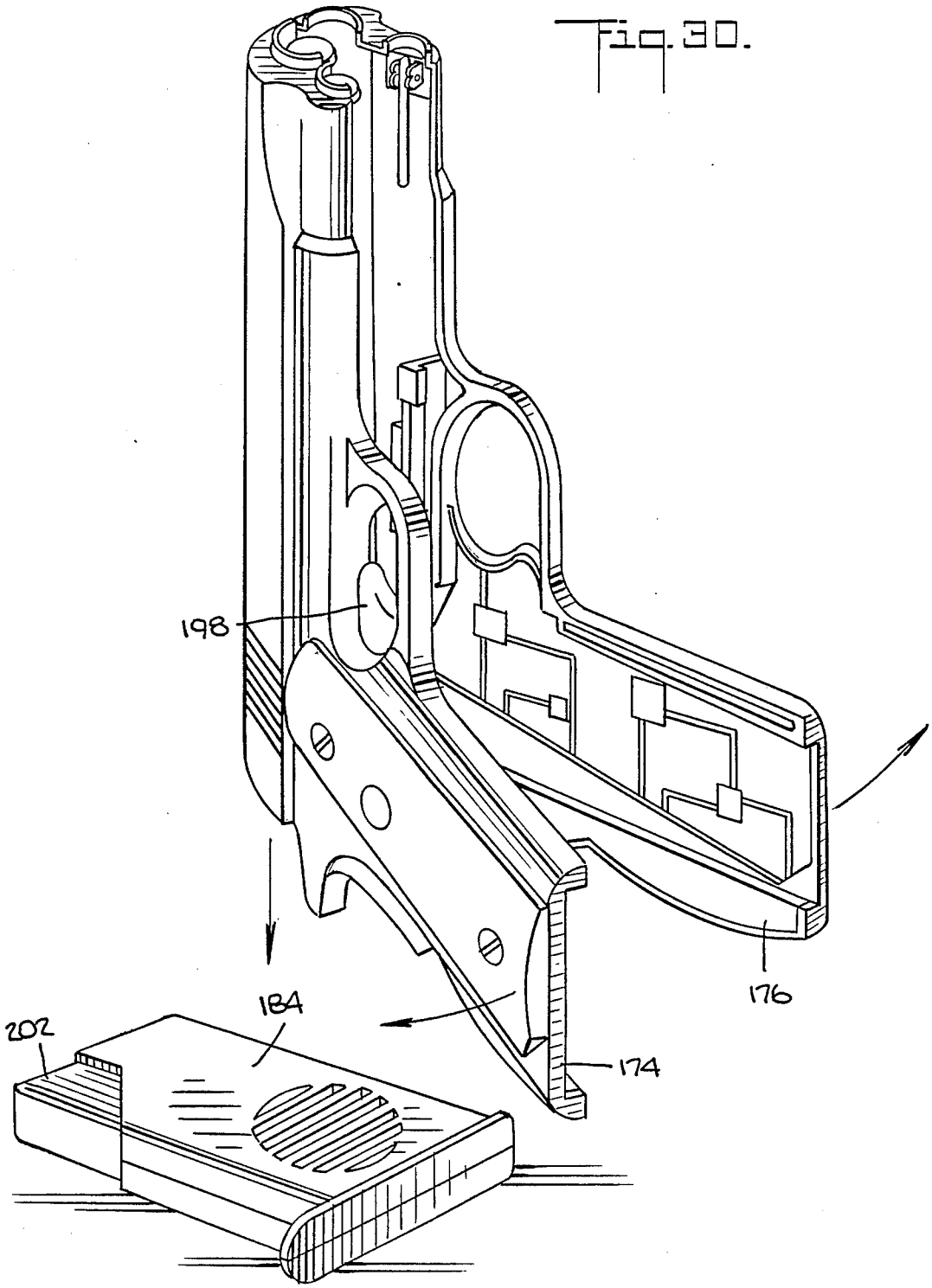
FIG. 30 is a perspective, exploded view showing the pistol in partially open position.
Figure 31:
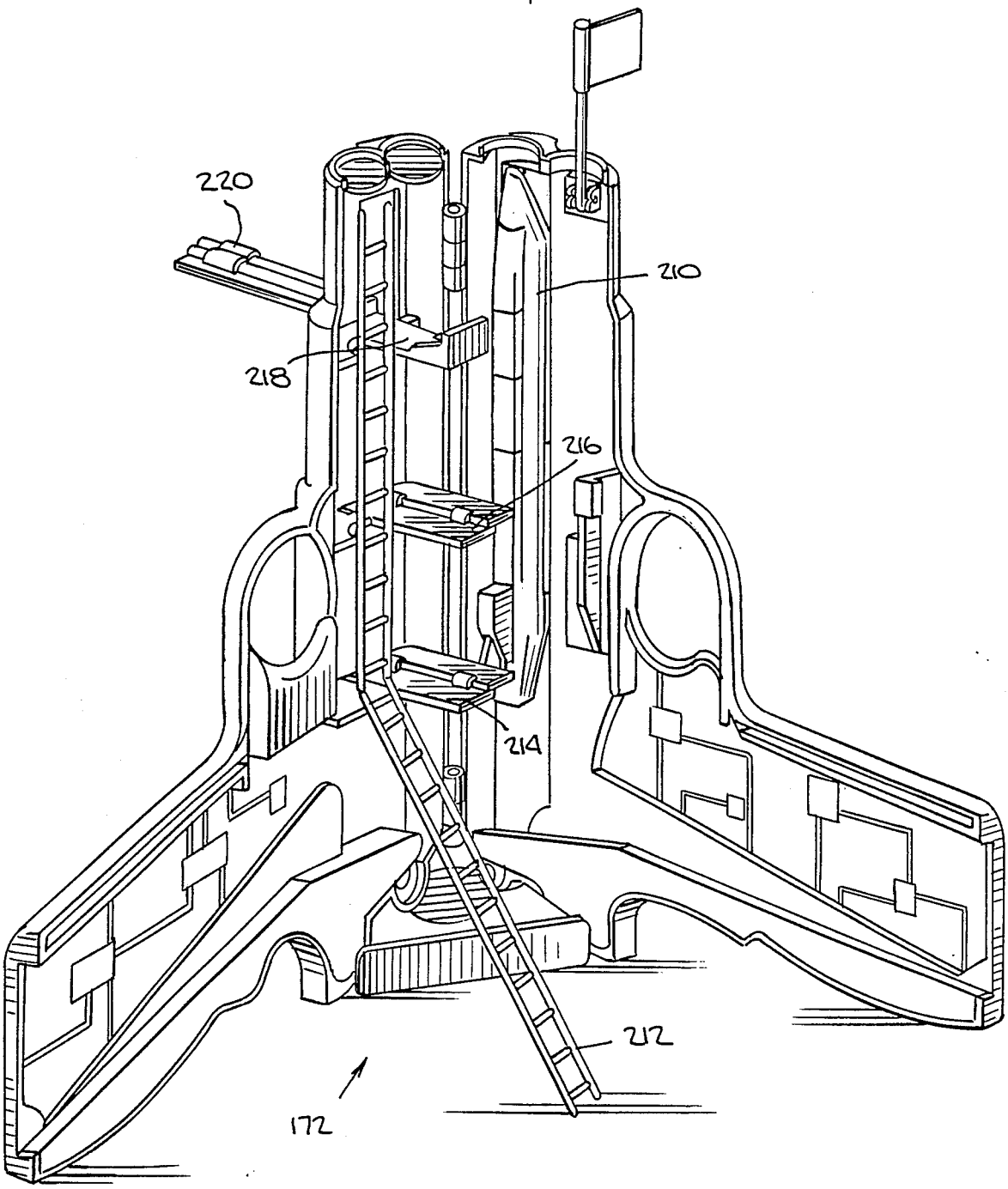
FIG. 31 is a front view of the pistol shown fully open and set up for use as a missile silo.
Figure 84:
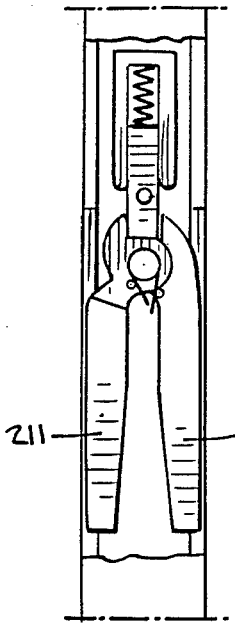
Figure 85:
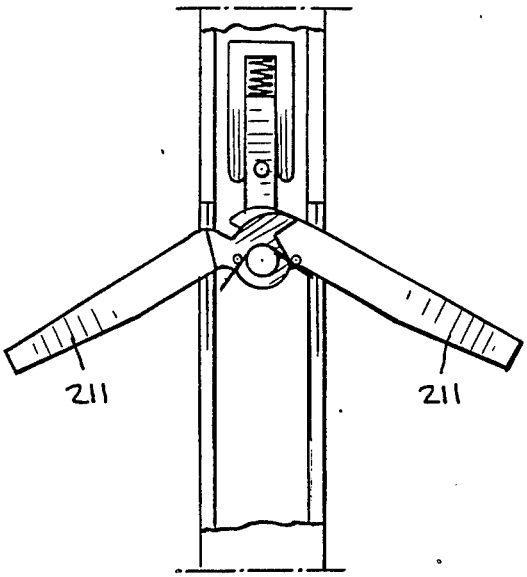
Figure 83:
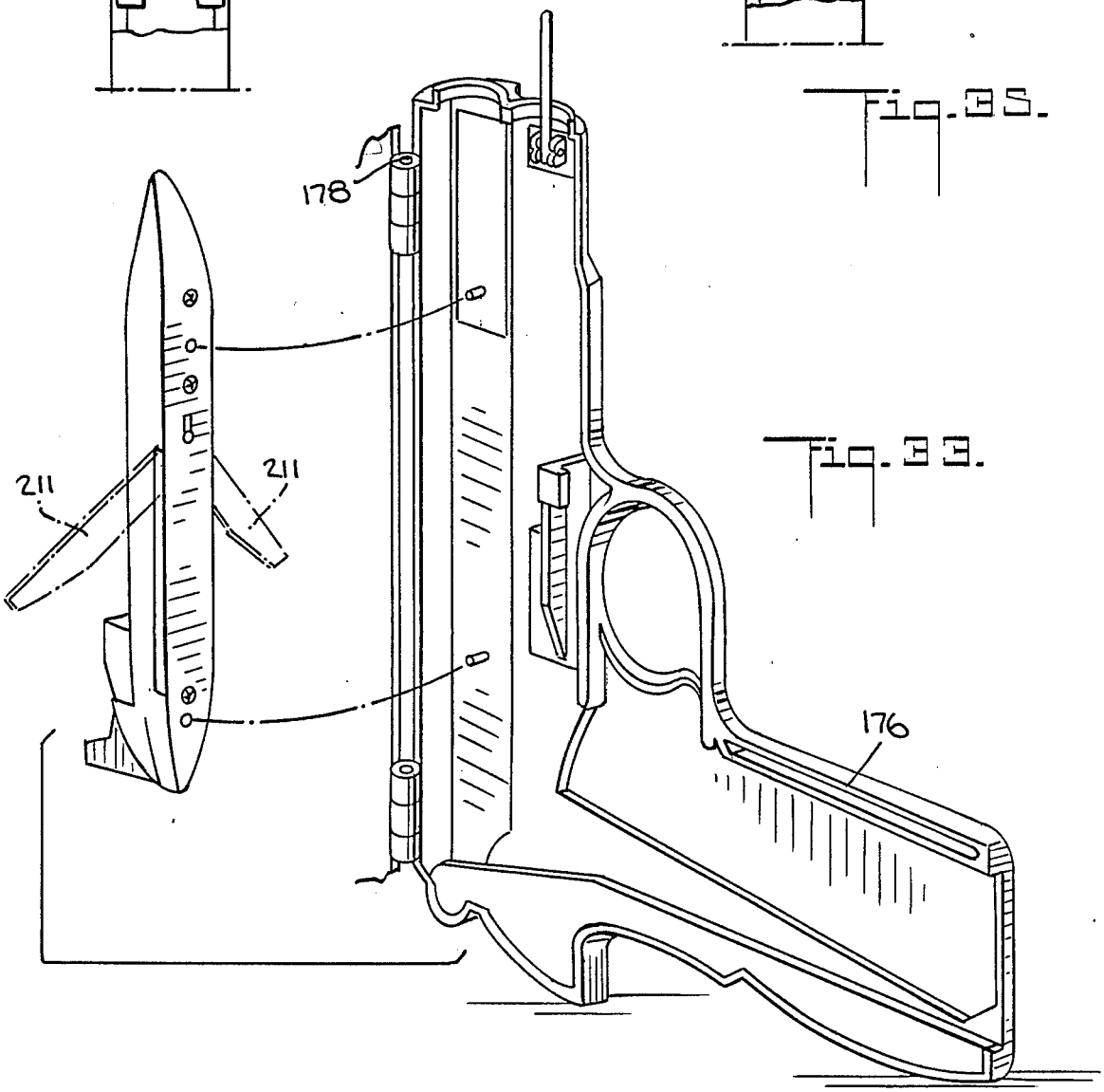

The fourth embodiment of the invention (FIGS. 23–35) is a useful article 170 in the form of a simulated pistol and embodied in it is a playset 172 in the form of a miniature missile silo (FIG. 31). As shown in FIG. 30, the pistol is comprised of two shells 174, 176 joined at the top by means of hinges 178. A slideable latch 180 on shell 176 is engageable with a keeper 182 on shell 174 to lock the two shells together when article 170 is to be used as a toy pistol.

It will be observed that a cartridge clip 184 is inserted into the pistol butt 186 when the article is used as a simulated pistol. This clip contains a clicker 188 comprising a spring-urged striker 190 that strikes a membrane 192 to produce a clicking sound. The membrane is one of the walls of a sound chamber 194 that communicates with a perforated wall section 196 of the cartridge clip. The clicking sound is readily heard through the perforations.

Figures 26, 27:
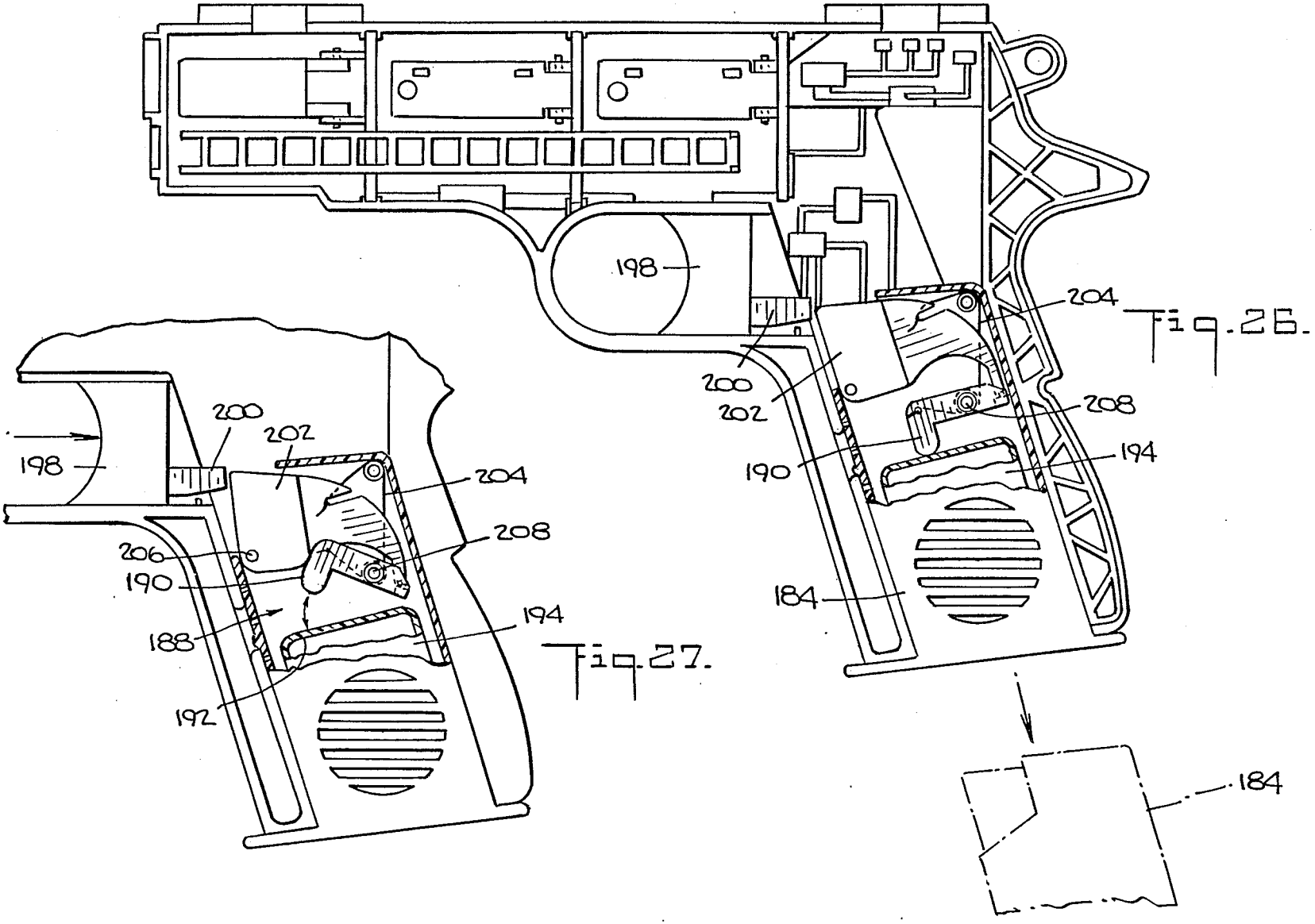
FIG. 26 is a side view of the pistol, partly broken away and in longitudinal section, showing a part of the inner toy set built into the pistol.
FIG. 27 is a fragmentary view, partly in longitudinal section, showing the trigger mechanism in operative position for producing a pistol-firing clicking sound.
Figure 32:
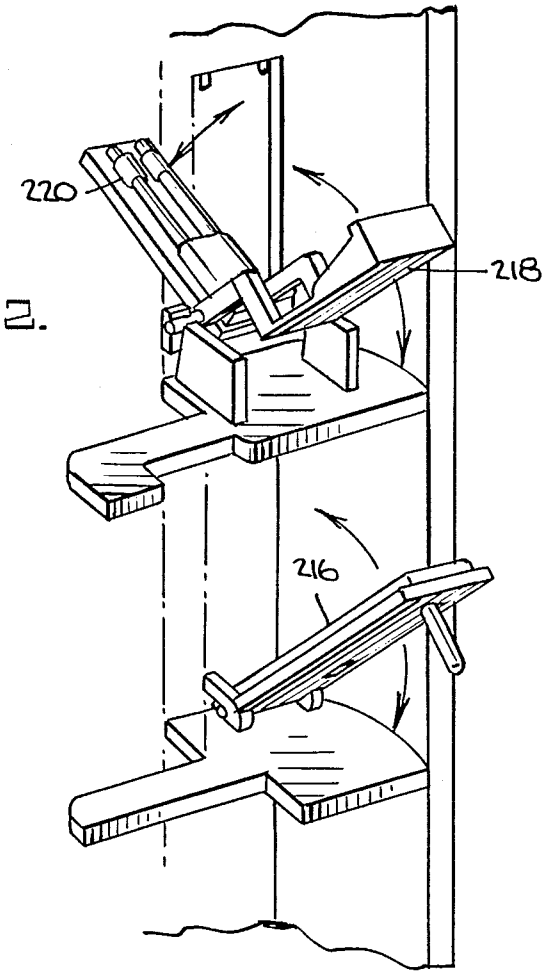
FIG. 32 is a fragmentary, perspective view of a detail of said missile silo.
Figure 29:
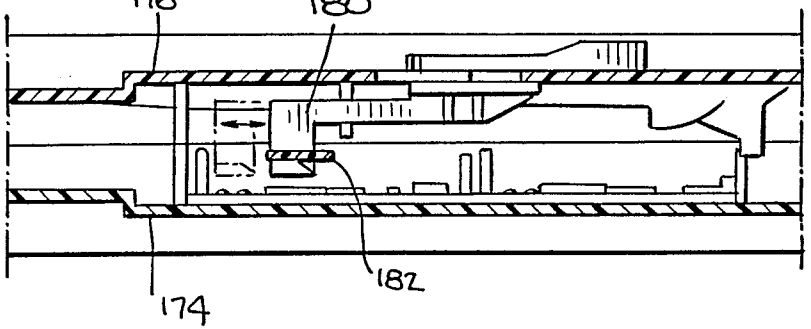
FIG. 29 is a fragmentary section on the line 29—29 of FIG. 28.
Figure 28:
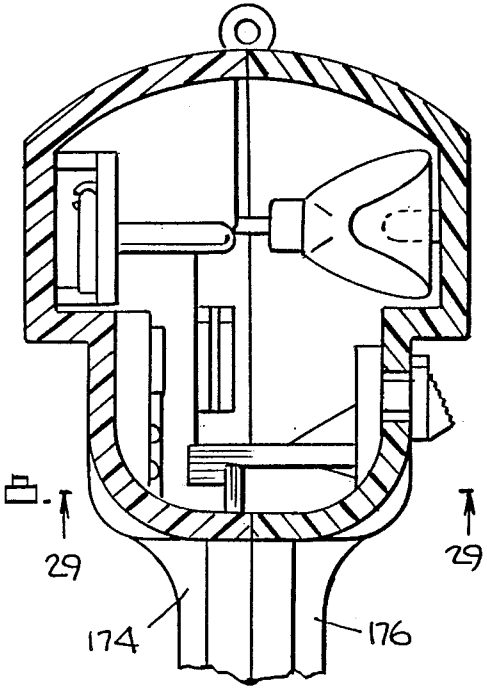
FIG. 28 is an enlarged cross-section on the line 28—28 of FIG. 23.

The clicking mechanism is connected to the trigger 198 of the pistol by means of a push bar 200 that engages a bellcrank 202. This bellcrank is biased by spring 204 in counterclockwise direction about pivot 206 (as viewed in FIG. 27). This causes the bellcrank to push against push bar 200 and trigger 198. The striker 190 is also biased by spring 204 in counterclockwise direction, in this case about pivot 208. When the trigger is released, the bellcrank holds the striker in the position shown in FIG. 27. When the trigger is pressed, the bellcrank releases the striker which then strikes the membrane as shown in FIG. 26.

To use the inner playset, the pistol is opened up and its two shells spread apart and stood up as shown in FIG. 31. The cartridge clip may be placed between the two shells to cooperate with their butt ends in order to provide a stable tripod support for the missile silo. It will be seen in FIG. 31 that various features of a missile silo are formed and provided on the inner walls of the two shells.

For example, a cruise missile 210 is supported on shell 176, this missile having spring-urged pivoting wings 211. See FIG. 35. A ladder 212, supported on shell 174, leads up to three levels in the silo, 214, 216, 218 respectively. The top level 218 is provided with an anti-aircraft battery 220.

Figure 38:
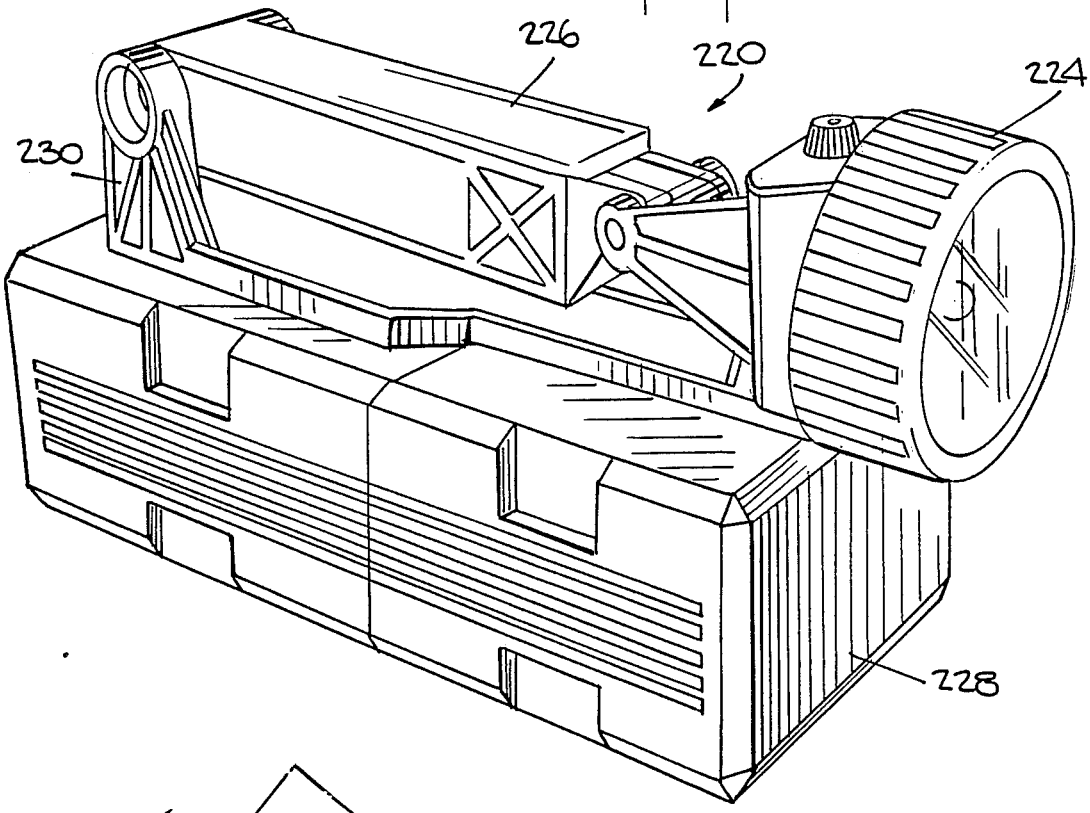
FIG. 38 is a top view thereof.
Figure 40:
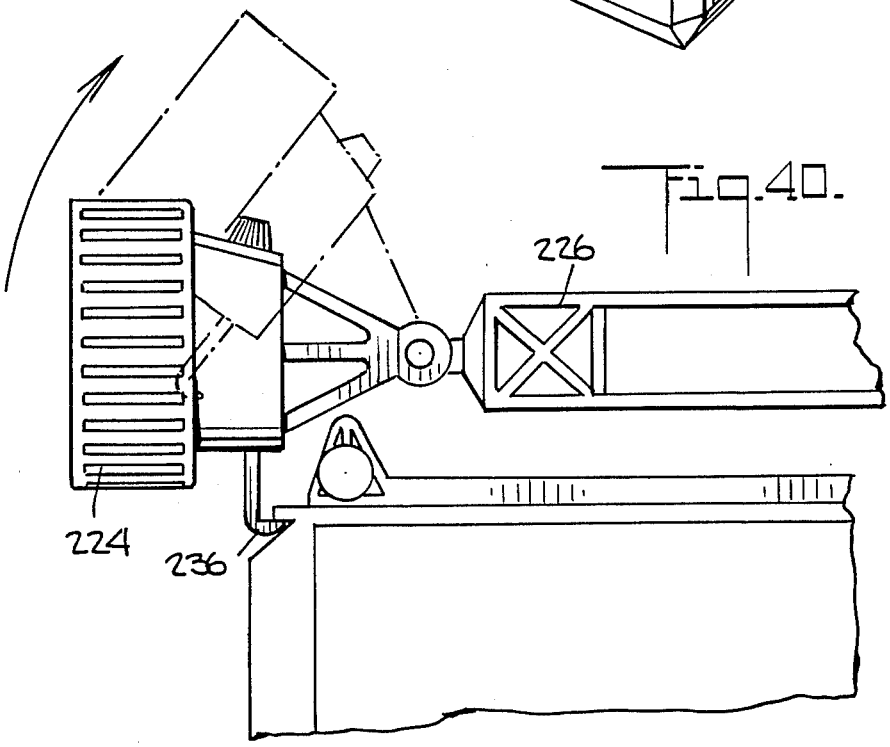
FIG. 40 is a fragmentary side view showing the swivel action of the searchlight.
Figure 37:
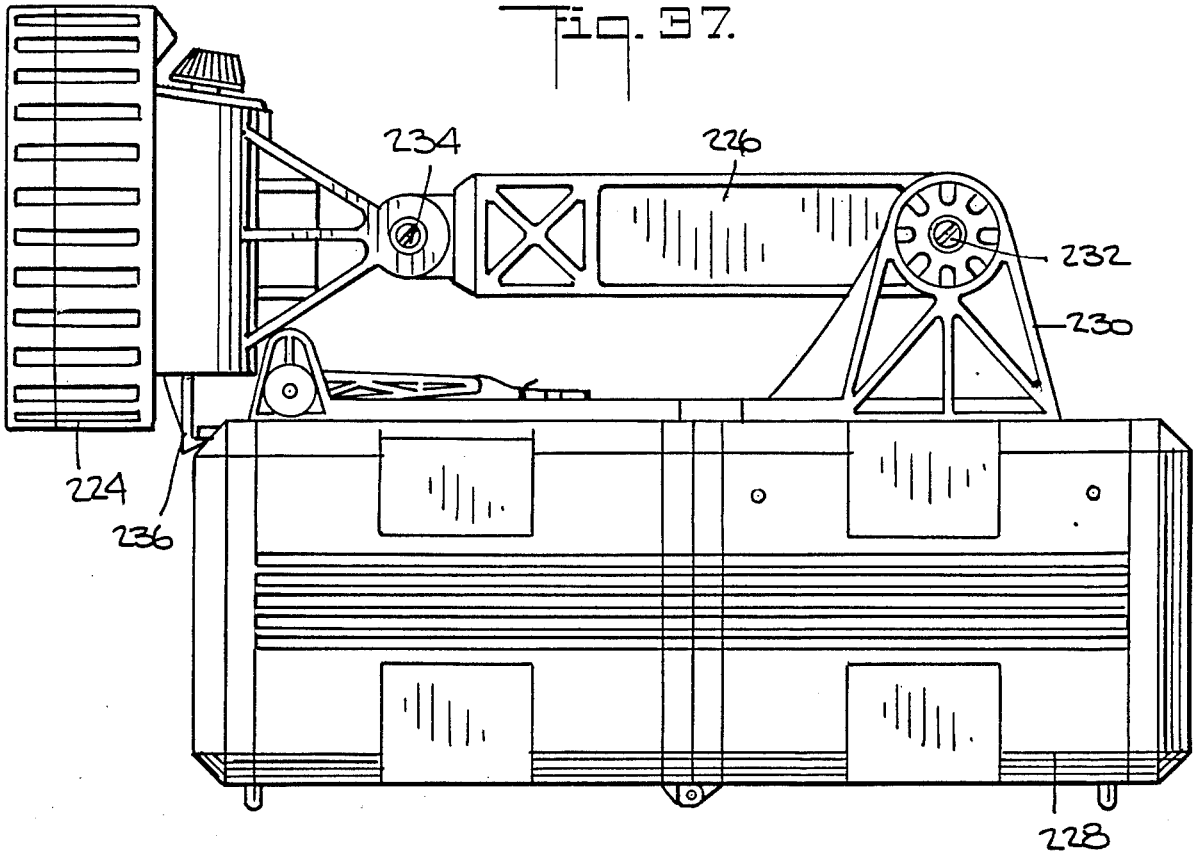
FIG. 37 is a side view of said searchlight.
Figure 38:
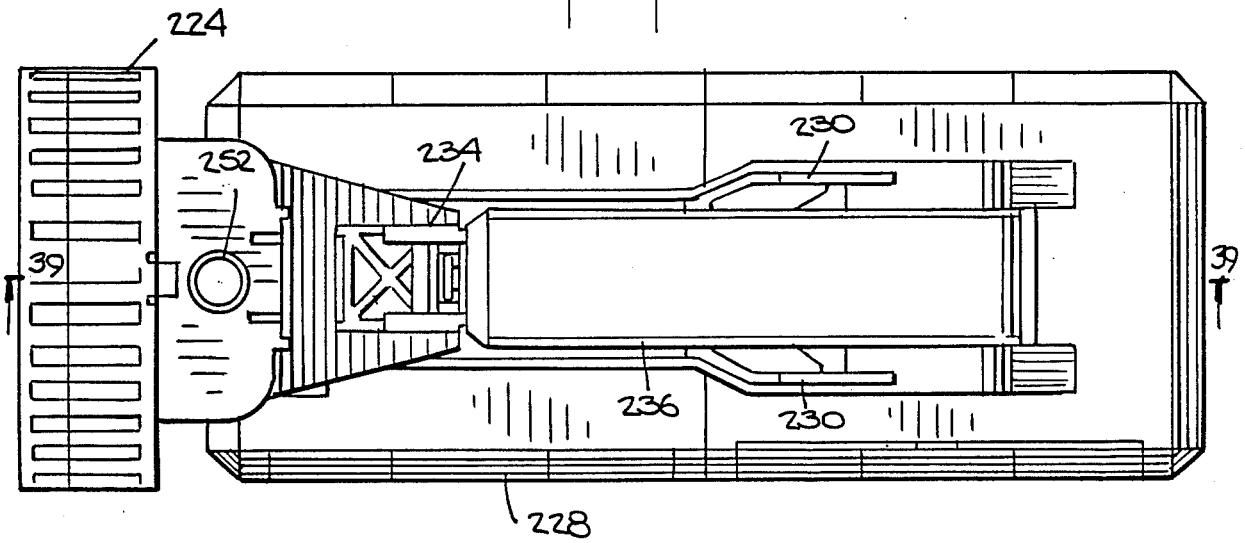
Figure 88:
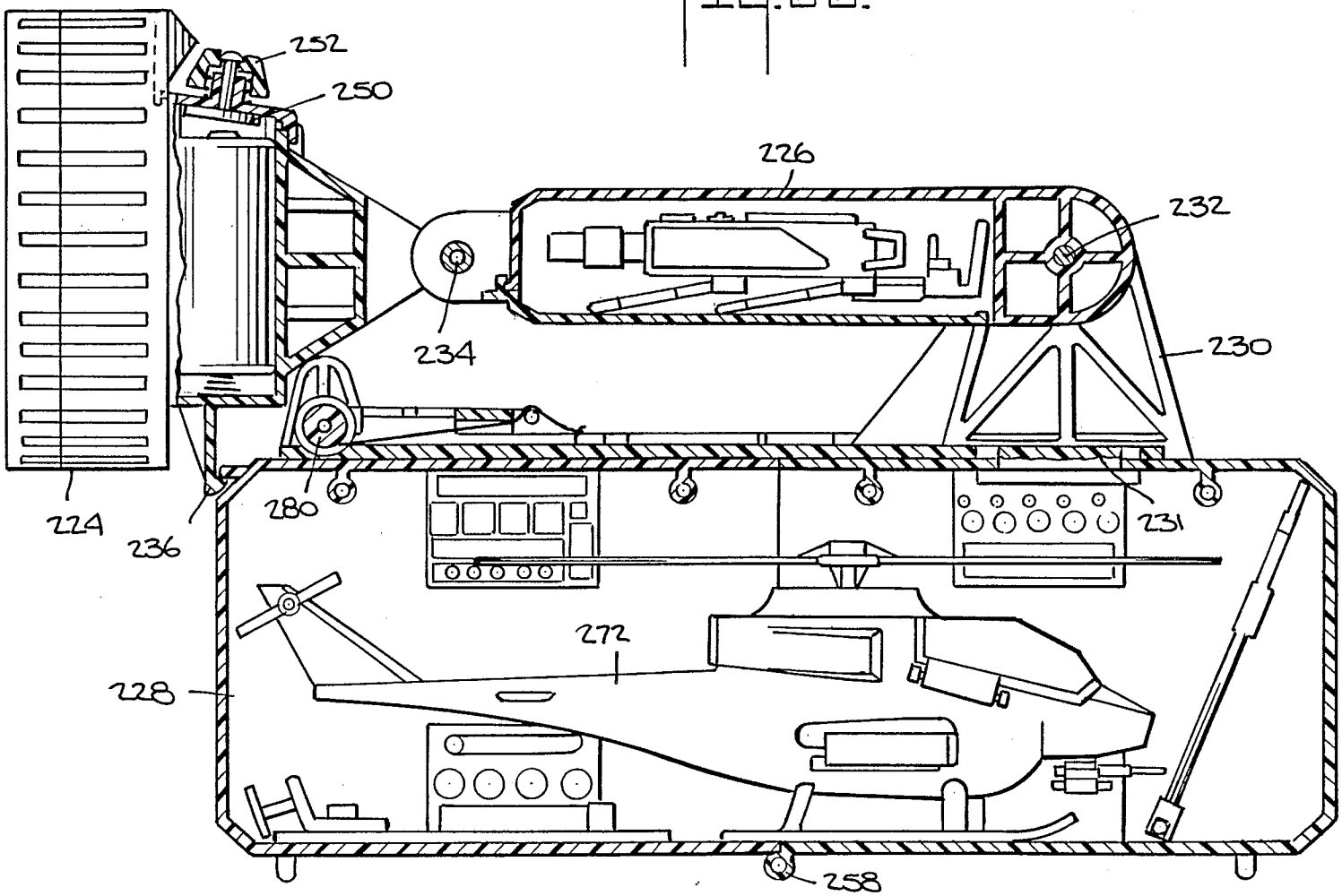
Figure 41:
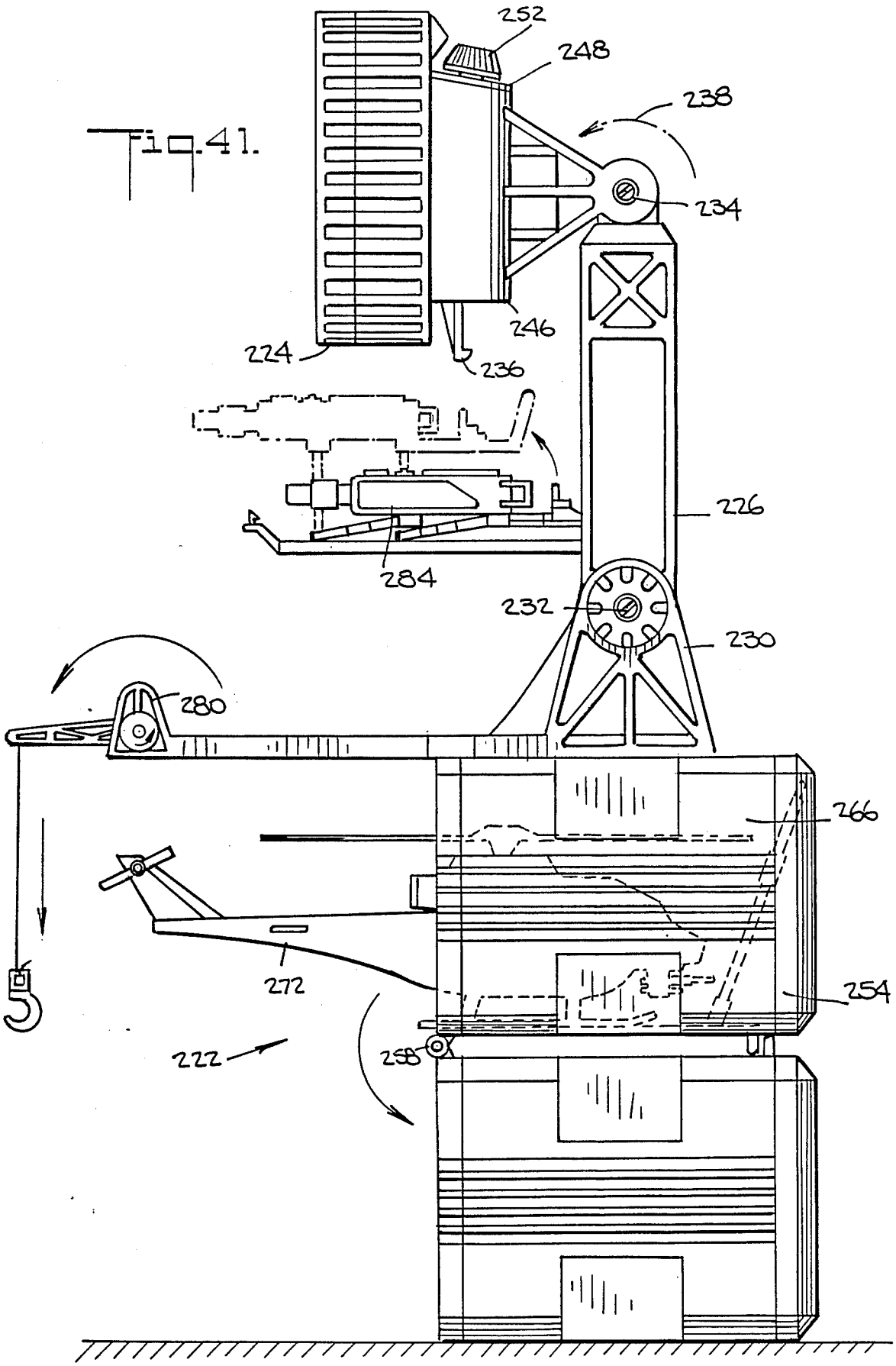
FIG. 41 is a side view of the searchlight showing it set up as an air defense station, showing a helicopter gunship projecting from a storage compartment.

The fifth embodiment of the invention (FIGS. 36–44) comprises a useful article 220 in the form of an actual searchlight unit, and embodied in it is a playset 222 in the form of a miniature ground to air defense unit. As shown in FIGS. 36–38, the searchlight unit comprises a searchlight proper 224, a handle 226 for carrying same, and a base 228 on which to stand the searchlight. A bracket 230 is rotatably mounted on the base by means of a swivel 231, and a pivot 232 on the bracket supports one end of handle 226. A pivot 234 at the opposite end of the handle supports the searchlight 224. The axes of pivots 232 and 234 are parallel to each other. The axis of the swivel is perpendicular to the axis of pivot 232.

It will be noted that a clip 236 locks the searchlight to the base to hold the entire unit 220 together for carrying or storing purposes. When the clip is disengaged, the handle may be raised to its position in FIG. 41 and the base may be stood on end to raise the searchlight to its uppermost position. Also, the searchlight may swivel about pivot 234 as indicated by arrow 238 in FIG. 41 and arrows 240, 242 in FIG. 43. AdditionallY, bracket 230 may swivel relative to the base.

Figures 42, 44:
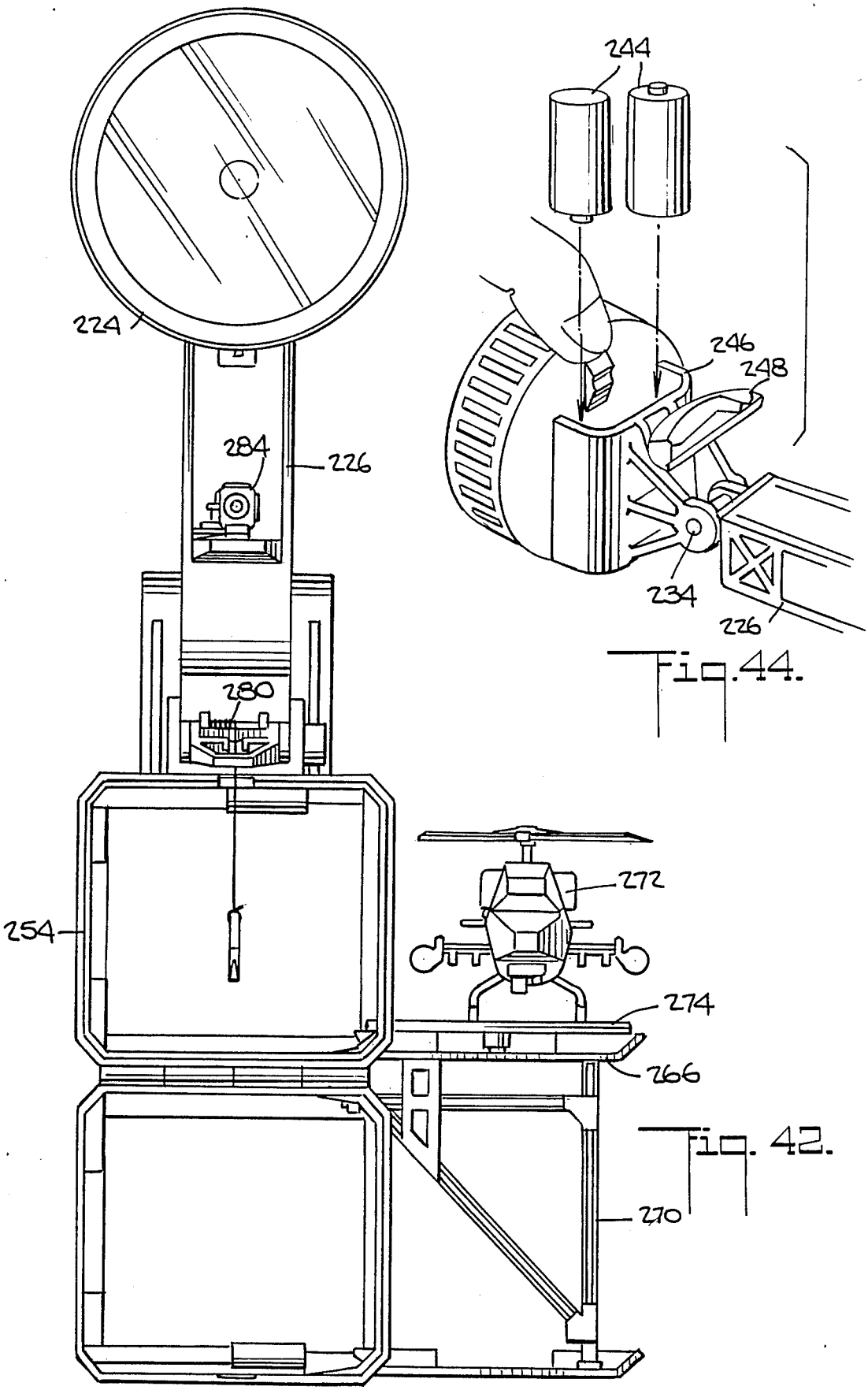
FIG. 42 is a front view thereof showing the helicopter gunship on a take-off and landing pad.
FIG. 44 is a fragmentary, perspective, exploded view of the searchlight element showing its switch and battery components.

Although base 228 would appear to contain searchlight batteries, the searchlight batteries that are actually used are batteries 244 shown in FIG. 44 and they are enclosed in battery compartment 246. A cover 248 closes said battery compartment. FIG. 39 shows the searchlight switch element 250 operated by switch control knob 252.

Figure 43:
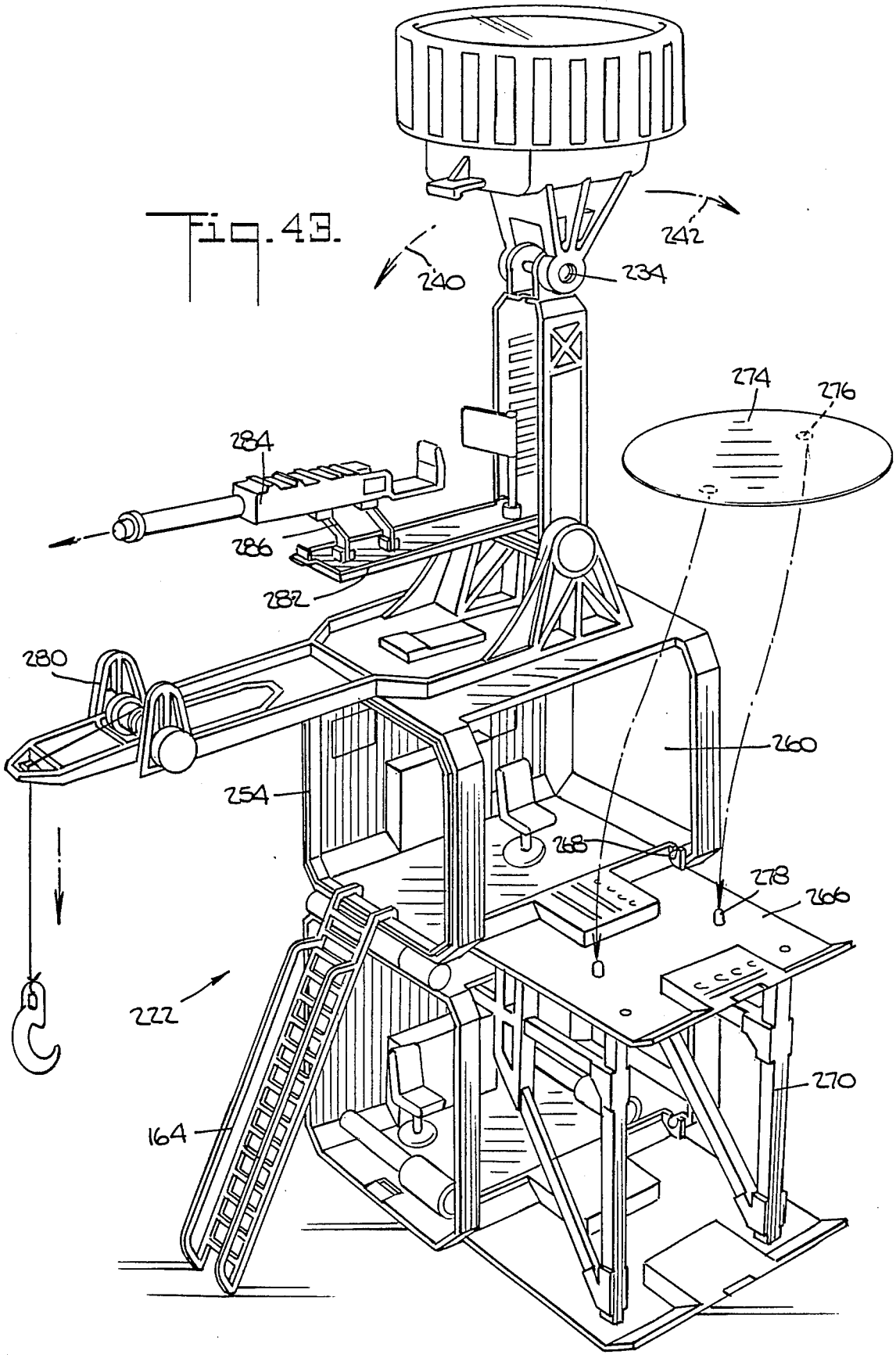
FIG. 43 is a perspective view of said searchlight showing its various air defense station facilities and features.

When the entire searchlight unit 220 is opened up and erected to its position in FIG. 43, the features of its playset 222 become available for use. Base 228 is shown to consist of two hollow blocks 254, 256 that are pivotally connected by hinge means 258. As shown in FIG. 43, block 256 now forms the base of the structure, block 254 rests on top of block 256, bracket 230 is supported on top of block 254, handle 226 is erected to vertical position on bracket 230 to serve as a tower, and searchlight 224 is supported on the handle/tower for swiveling action thereon. Two control and operations rooms 260, 262 are formed, respectively, in blocks 254, 256. A ladder 164 provides access to upper room 260. Panel 266 on hinge elements 268 swings down from block 254 coming to rest on framework 270 and forming a platform for helicopter gunship 272. A disc 274 is provided with holes 276 that receive posts 278 on panel platform 266. When disc 274 is placed over posts 278, it forms a landing and take-off pad for the helicopter.

There are other features in the playset, e.g., a hoist 280 extending from bracket 230. A hinged panel 282 drops down from the handle/tower 226 to form a platform for a gun 284, the gun being mounted on hinged supports 286 for raising into firing position.

The foregoing embodiments of the invention illustrate the basic elements of the invention, namely, a useful article in generally normal size, adapted to be used by children in play or in related activities, and an inner playset builds into a useful article and of miniature size relative to the useful article. The nature and configuration of the useful article do not necessarily reflect the nature and configuration of the inner playset, e.g., a useful article in the form of a canteen does nothing to suggest a playset in the form of an aircraft carrier. It should also be understood that the invention is not limited to the simulated military objects depicted in the drawings. The invention has a wide use in all kinds of toys and playsets for children.

What is claimed is:

1. A multi-use toy comprising:

a. a useful article adapted for play use by children;

b. said useful article having the configuration of a type of article recognizable by children and being of generally normal size for that type of article;

c. said useful article having at least one inner compartment, d. a toy set built into said compartment, e. said toy set being of miniature size relative to the size of the useful article;

f. said useful article being adapted to be opened to expose said toy set and being adapted to be closed to enclose said toy set;

g. said useful article, when closed, being adapted to be used as a toy;

h. said toy set being adapted to be used as a toy when the useful article is opened;

i. said useful article, when closed, being additionally adapted to function as a storing and carrying case for the toy set;

j. said useful article, when open, being additionally adapted to function as a support for said toy set, and k. wherein the useful article comprises a simulated canteen; and l. the toy set comprises a simulated aircraft carrier.

2. A multiple-use toy in accordance with claim 1, wherein:

a. the useful article is provided with a second compartment; and b. said second compartment housing a simulated jet fighter.

3. A multi-use toy comprising:

a. a useful article adapted for play use by children;

b. said useful article having the configuration of a type of article recognizable by children and being of generally normal size for that type of article;

c. said useful article having at least one inner compartment;

d. a toy set built into said compartment;

e. said toy set being of miniature size relative to the size of the useful article;

f. said useful article being adapted to be opened to expose said toy set and being adapted to be closed to enclose said toy set;

g. said useful article, when closed, being adapted to be used as a toy;

h. said toy set being adapted to be used as a toy when the useful article is opened;

i. said useful article, when closed, being additionally adapted to function as a storing and carrying case for the toy set;

j. said useful article, when open, being additionally adapted to function as a support for said toy set, and k. wherein the useful article comprises a simulated canteen; and l. the toy set comprises a simulated aircraft carrier; and m. wherein the simulated canteen is provided with a compartment that houses an actual water container; and n. said water container is provided with a spout and a closure therefor.

4. A multiple-use toy in accordance with claim 3, wherein:

a. the simulated aircraft carrier is provided with two flight deck sections;

b. the water container compartment being situated under one flight deck section; and c. the jet fighter compartment being situated under another flight deck section.

5. A multi-use toy comprising:

a. a useful article adapted for play use by children;

b. said useful article having the configuration of a type of article recognizable by children and being of generally normal size for that type of article;

c. said useful article having at least one inner compartment;

d. a toy set built into said compartment;

e. said toy set being of miniature size relative to the size of the useful article;

f. said useful article being adapted to be opened to expose said toy set and being adapted to be closed to enclose said toy set;

g. said useful article, when closed, being adapted to be used as a toy;

h. said toy set being adapted to be used as a toy when the useful article is opened;

i. said useful article, when closed, being additionally adapted to function as a storing and carrying case for the toy set;

j. said useful article, when open, being additionally adapted to function as a support for said toy set, and k. wherein the useful article comprises a simulated canteen;

l. the toy set comprises a simulated aircraft carrier; and m. wherein the simulated canteen is provided with a belt clip for carrying purposes.

* * * * *